US011712597B2

(12) United States Patent
Carlson

(10) Patent No.: US 11,712,597 B2
(45) Date of Patent: Aug. 1, 2023

(54) WEIGHTLIFTING EXERCISING SYSTEM

(71) Applicant: Adam Carlson, Rochester, MN (US)

(72) Inventor: Adam Carlson, Rochester, MN (US)

( * ) Notice: Subject to any disclaimer, the term of this patent is extended or adjusted under 35 U.S.C. 154(b) by 0 days.

(21) Appl. No.: 17/943,688

(22) Filed: Sep. 13, 2022

(65) Prior Publication Data

US 2023/0123978 A1 Apr. 20, 2023

Related U.S. Application Data

(63) Continuation of application No. 17/504,629, filed on Oct. 19, 2021, now Pat. No. 11,458,349.

(51) Int. Cl.

| | |
|---|---|
| ***A63B 21/078*** | (2006.01) |
| ***A63B 21/06*** | (2006.01) |
| ***A63B 21/08*** | (2006.01) |
| ***A63B 21/00*** | (2006.01) |
| ***A63B 23/04*** | (2006.01) |

(52) U.S. Cl.

CPC ..... *A63B 21/078* (2013.01); *A63B 21/00065* (2013.01); *A63B 21/0615* (2013.01); *A63B 21/08* (2013.01); *A63B 21/4035* (2015.10); *A63B 2023/0411* (2013.01)

(58) Field of Classification Search

CPC ..... A63B 21/00065; A63B 21/0615; A63B 21/0616; A63B 21/0617; A63B 21/0724; A63B 21/078; A63B 21/0783; A63B 21/08; A63B 21/4035

See application file for complete search history.

(56) References Cited

U.S. PATENT DOCUMENTS 2,855,199 A * 10/1958 Noland ..... A63B 23/0494 601/24
4,405,128 A * 9/1983 Mclaughlin ..... A63B 21/08 601/24
4,502,681 A * 3/1985 Blomqvist ..... A63B 23/03516 482/130
4,923,195 A * 5/1990 Calderone ..... A63B 23/1281 482/97

(Continued)

FOREIGN PATENT DOCUMENTS

AU 2020101445 5/2018

OTHER PUBLICATIONS

Morning Lifter DIY Leg Curls and Extensions Published Aug. 31, 2020 http://youtube .comwatch?v=ZUDfCAL6KM>(Lifter).

*Primary Examiner* — Andrew S Lo
*Assistant Examiner* — Zachary T Moore

(57) ABSTRACT

A weightlifting exercising system includes a frame having a pair of columns. A pair of lifting assemblies is provided and each of the columns has one of the lifting assemblies mounted thereon. The lifting assemblies each include a mount and an axle extending through the mount and rotational relative to the mount. A first arm is fixedly attached to the axle. A second arm is rotationally coupled to the axle. A lift angle is defined between the first and second arms and is alterable from 0° to 180°. A locking member releasably locks the second arm with respect to the axle such that the lift angle is releasably retained. One of the first and second arms has a handle attached thereto and the other of the first and second arms has a weight receiver attached thereto. One or more weight plates is removably positionable on the weight receiver.

10 Claims, 24 Drawing Sheets

(56) References Cited

U.S. PATENT DOCUMENTS

| | | | | |
|---|---|---|---|---|
| 10,016,648 | B2 | 7/2018 | Briley | |
| 10,422,473 | B2 | 9/2019 | Inouye | |
| 10,646,744 | B2 * | 5/2020 | Steenekamp | A63B 1/005 |
| 11,173,337 | B2 * | 11/2021 | Jones | A63B 17/00 |
| 11,583,720 | B2 * | 2/2023 | Gedeon-Janvier | A63B 21/0615 |
| 2003/0017918 | A1 * | 1/2003 | Webb | A63B 21/156 482/99 |
| 2007/0054785 | A1 * | 3/2007 | Drechsler | A63B 21/156 482/94 |
| 2017/0319905 | A1 * | 11/2017 | O'Connor | A63B 21/00181 |
| 2019/0099636 | A1 | 4/2019 | Schmidt | |
| 2019/0201734 | A1 * | 7/2019 | Sorin | A63B 17/04 |
| 2019/0217148 | A1 | 7/2019 | Bruni | |
| 2019/0269963 | A1 * | 9/2019 | Steenekamp | A63B 21/0622 |
| 2019/0275363 | A1 * | 9/2019 | Jones | A63B 21/0616 |
| 2020/0094096 | A1 | 3/2020 | Sorin | |
| 2020/0197737 | A1 | 6/2020 | Kistner | |

* cited by examiner

WEIGHTLIFTING EXERCISING SYSTEM

STATEMENT REGARDING FEDERALLY SPONSORED RESEARCH OR DEVELOPMENT

I hereby claim the benefit under 35 U.S.C., Section 120 of U.S. application Ser. No. 17/504,629 filed Oct. 19, 2021.

CROSS-REFERENCE TO RELATED APPLICATIONS

The Names of the Parties to a Joint Research Agreement

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercising device and more particularly pertains to a new exercising device for allowing a person to perform a wide variety of lifting exercises with adjustments to an angle formed a pair of arms pivotally coupled together, wherein one of the arms includes a handle grip and the other includes weights. Additionally, the device herein is mountable to a squat rack type frame and allows for the lowering and raising of the arms to further increase the number of exercises that can be performed by a user of the device.

(2) Description of Related Art Including Information Disclosed Under 37 CFR 1.97 and 1.98

The prior art relates to exercising devices that allow for the manipulation of weights during pulling and pushing type of exercises typically associated with working out muscles in the chest, back, shoulders and arms. However, these devices tend to be limited to a specific area of the body, such as back, and are not well suited for other areas of the body. Thus, multiple exercise machines are required for a complete body workout. The invention described herein provides for multiple exercise variations such that a single piece of exercise equipment allows for a more complete body workout.

BRIEF SUMMARY OF THE INVENTION

An embodiment of the disclosure meets the needs presented above by generally comprising a frame including a pair of columns. A pair of lifting assemblies is provided and each of the columns has one of the lifting assemblies mounted thereon. The lifting assemblies each include a mount releasably engaging one of the columns. An axle, having a rotational axis, extends through the mount and is rotational relative to the mount. A first arm is fixedly attached to the axle such that movement of the first arm rotates the axle. A second arm is rotationally coupled to the axle. A lift angle is defined between the first and second arms wherein the axle defines a vertex of the lift angle and wherein the lift angle is alterable from 0° to 180°. A locking member releasably locks the second arm with respect to the axle such that the lift angle is releasably retained. One of the first and second arms has a handle attached thereto and the other of the first and second arms has a weight receiver attached thereto. One or more weight plates is removably positionable on the weight receiver.

Another embodiment for retrofitting to a lever arm includes a frame having a vertically orientated column. A connector is mounted the column. A leverage arm is pivotally attached to the connector such that the leverage arm is pivotal only in a vertical plane. A weight receiver is positioned distal to the connector and is used to releasably engage one or more weight plates. A grip is attached to the leverage arm adjacent to the weight receiver. A mount releasably engages the leverage arm between a pivot end of the leverage arm and a weight end of the leverage arm. A spindle extends through the mount and has an axis orientated perpendicular to the vertical plane. A plate is rotatably mounted on the spindle. The plate is releasably restrained with respect to the mount to retain the plate at a selected rotational position relative to the mount. A lift arm is attached to the plate and has distal end and a proximal end relative to the plate. An angle between the lift arm and the leverage arm is alterable from 0° to 180° by rotation of the plate. A handle is attached to the lift arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
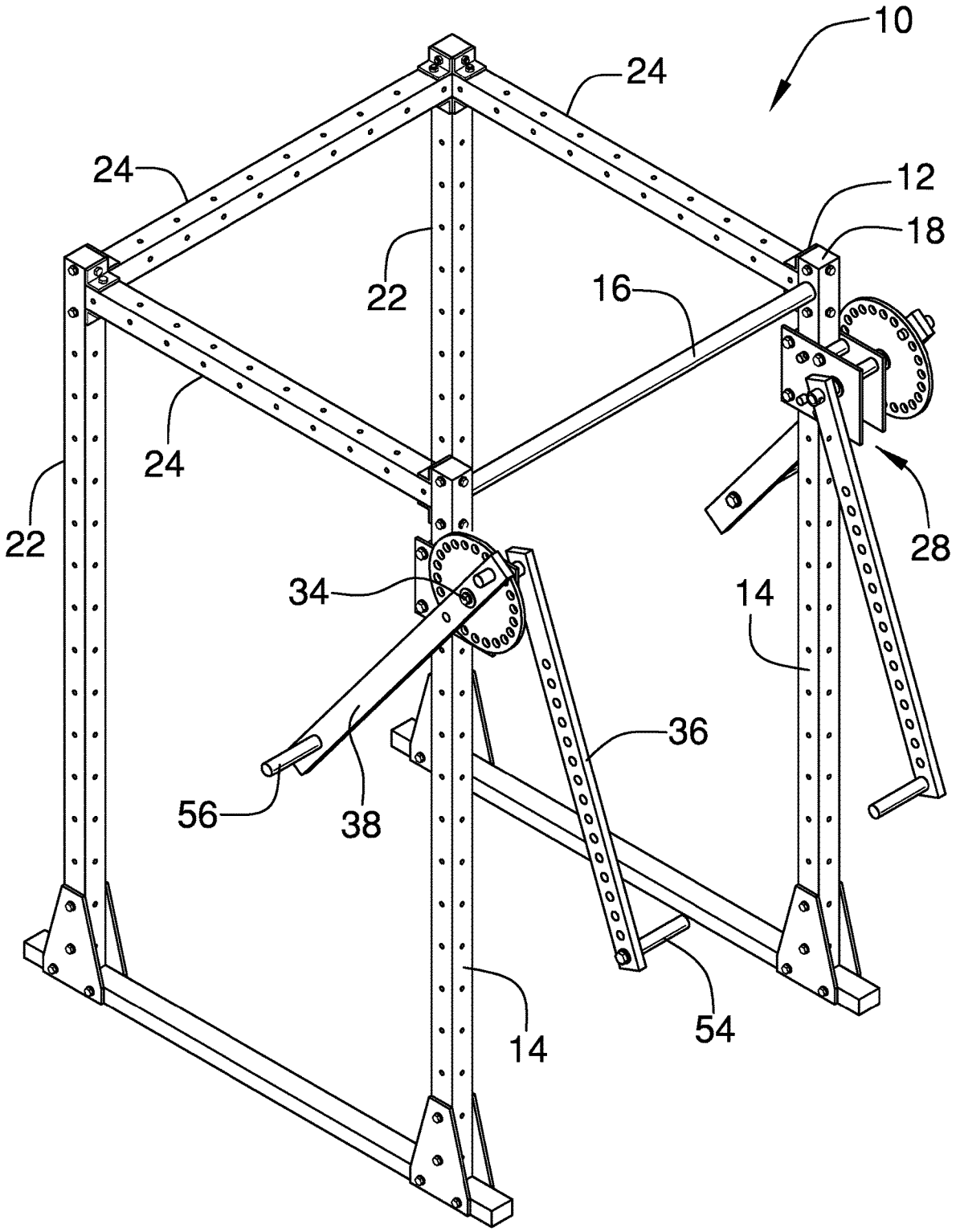
FIG. 1 is a front isometric view of a weightlifting exercising system according to an embodiment of the disclosure.
Figure 2:
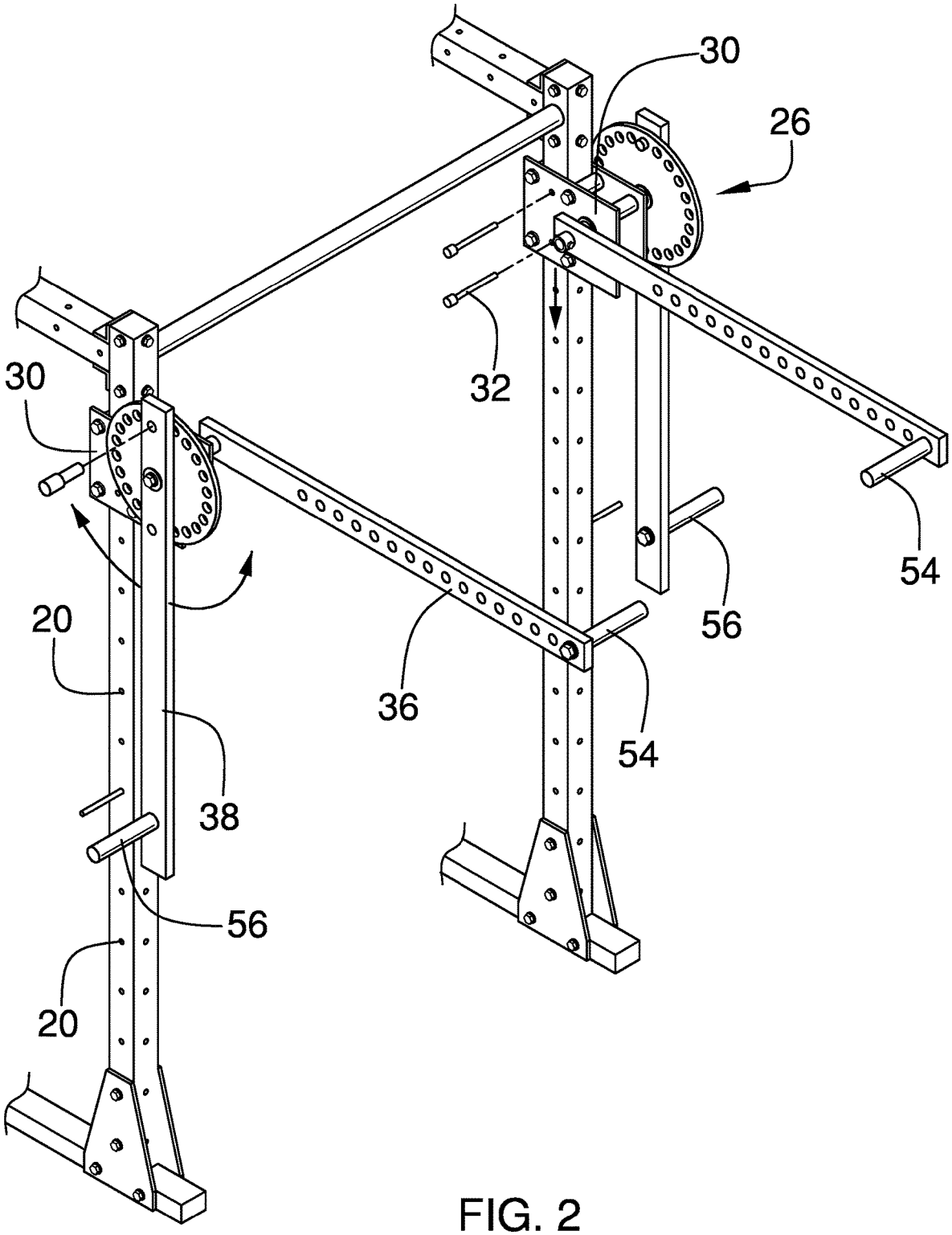
FIG. 2 is a front isometric view of an embodiment of the disclosure.
Figure 3:
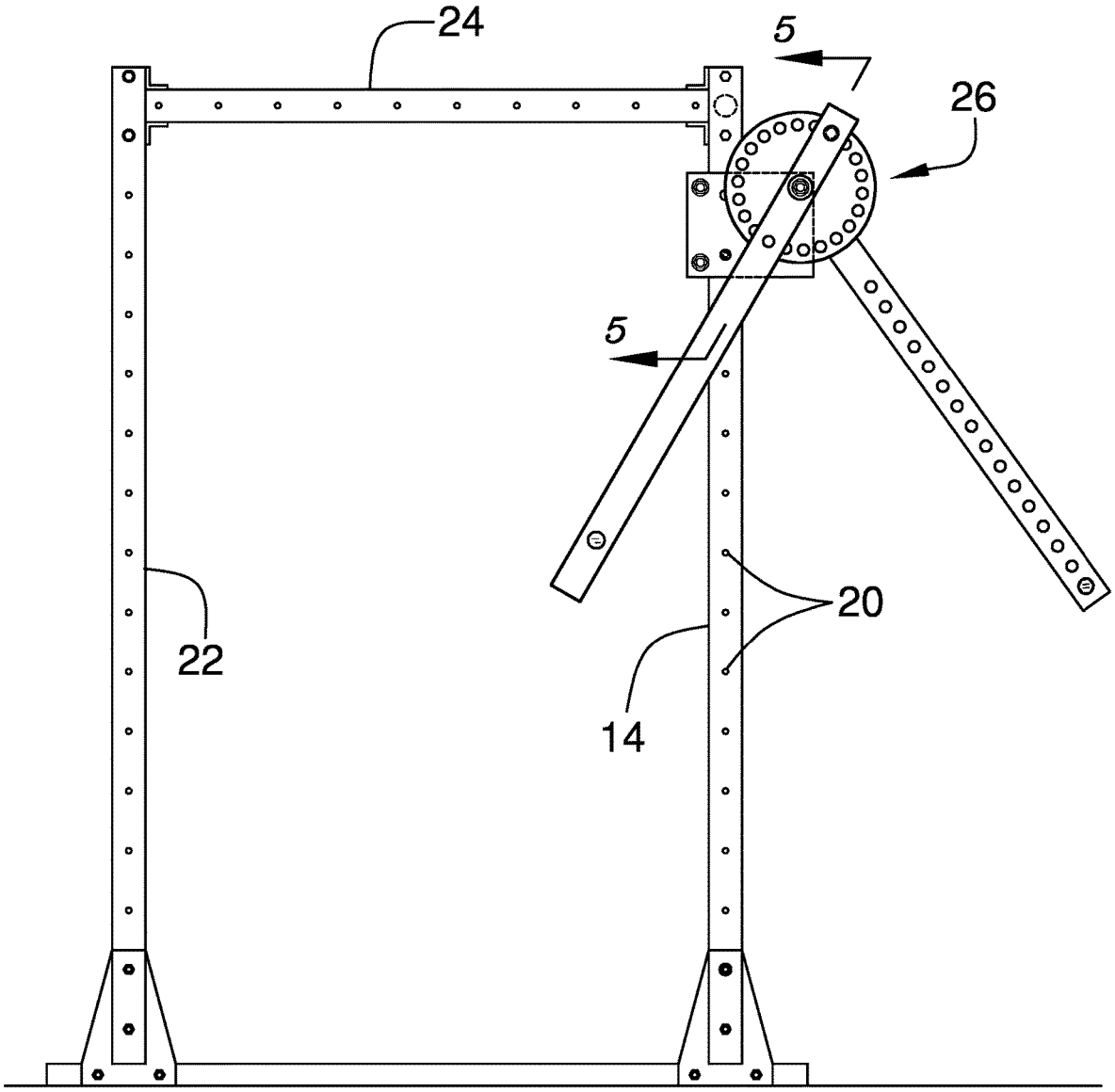
FIG. 3 is a side view of an embodiment of the disclosure.
Figure 4:
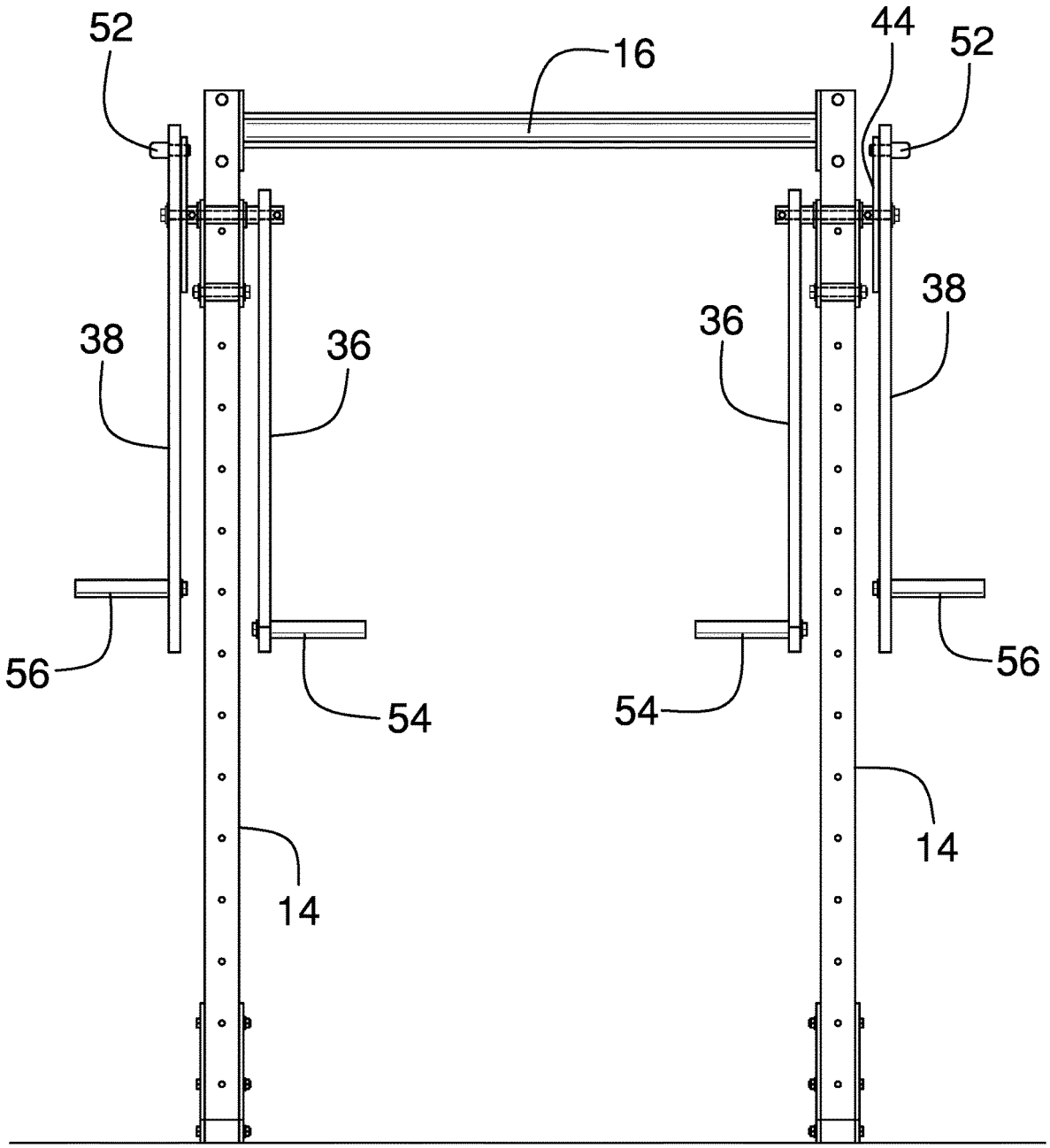
FIG. 4 is a front view of an embodiment of the disclosure.
Figure 5:
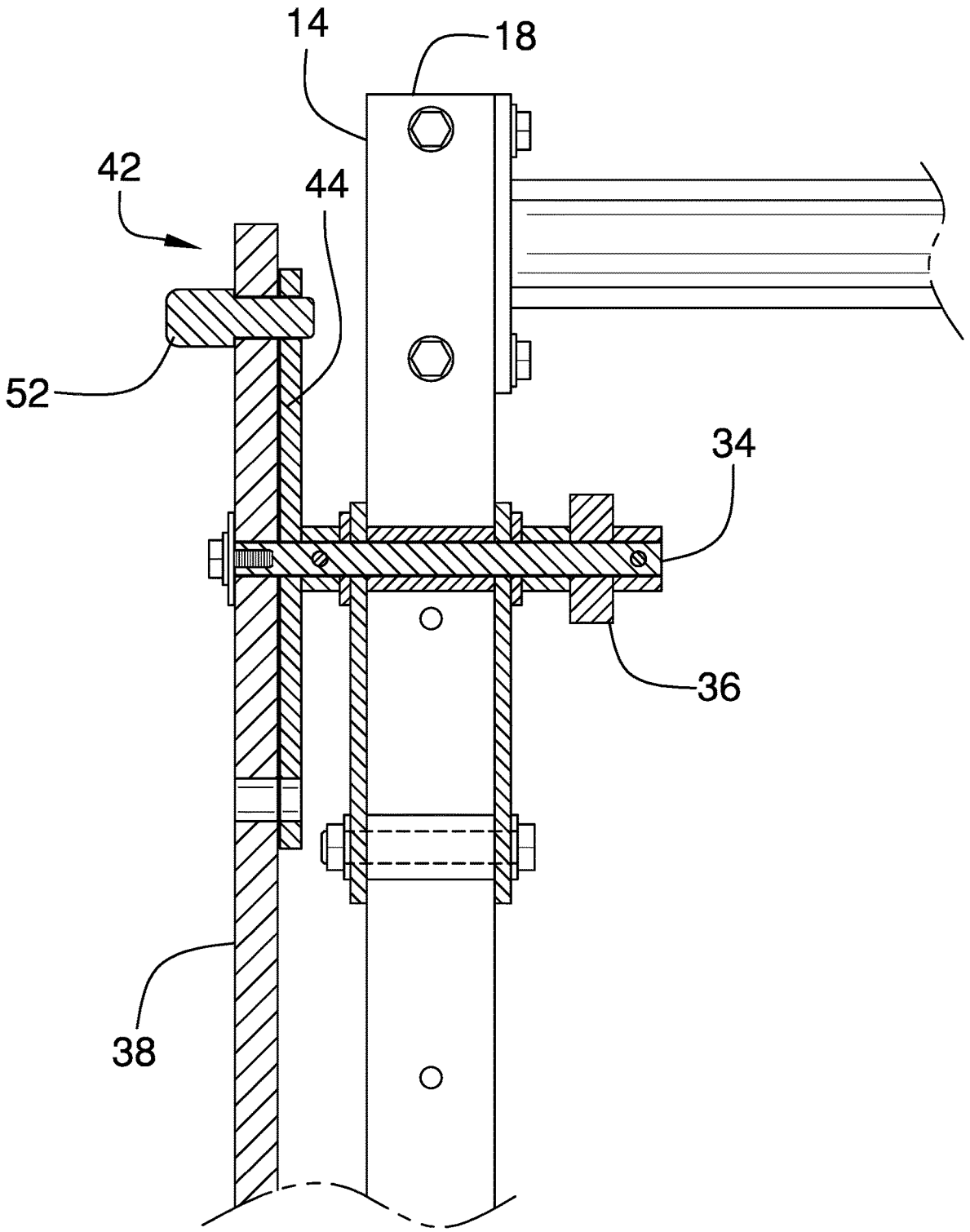
FIG. 5 is a cross-sectional view of an embodiment of the disclosure taken along line 5-5 of FIG. 3.

With reference now to the drawings, and in particular to FIGS. 1 through 25 thereof, a new exercising device embodying the principles and concepts of an embodiment of the disclosure and generally designated by the reference numeral 10 will be described.

As best illustrated in FIGS. 1 through 25, the weightlifting exercising system 10 generally comprises a frame 12 including a pair of columns 14. As shown in FIG. 1, each of the columns 14 is vertically orientated and the columns 14 are laterally spaced from each other. As can be seen in the Figures, the columns 14 are secured to each other such as with a beam 16 extending between upper ends 18 of the columns 14. The beam 16 may be cylindrical such that it can be used for exercises such as, but not limited to, pullups. Each of the columns 14 has a plurality of apertures 20 extending therethrough and are vertically aligned with each other. The frame 12 includes a pair of posts 22 laterally spaced from each other and secured to each other, wherein each of the posts 22 may be rearwardly aligned with one of the columns 14 such that the frame has a generally rectangular, box-like configuration and includes 4 vertical legs in total each having a height greater than 5.0 feet. A plurality of supports 24 is attached to and extends between each of the posts 22 and a forwardly associated one of the columns 14 to increase the stability of the frame 12. In some aspects, the frame 12 may define and also be used, independently of the system 10, as what is conventionally known as a squat rack comprised of rigid, metallic materials such as steel. The apertures 20 therefore may not only be positioned on lateral sides of the columns 14, but also on the posts 22, supports 24, and front and rear sides of each of the same.

A pair of lifting assemblies 26 is provided and are typically used in tandem with each other. The lifting assemblies 26, however, may be used in some circumstances independently from each other in a solo condition. Each of the columns 14 has one of the lifting assemblies 26 mounted thereon. In some embodiments, the lifting assemblies 26 are vertically movable along an associated one of the columns 14 for reasons which will become clear below. Each of the lifting assemblies 26 is releasably lockable at a selected position on the associated one of the columns 14. That is, the lifting assemblies 26 may be placed nearer or farther from the upper ends 18 of the columns 14 as needed.

Figure 6:
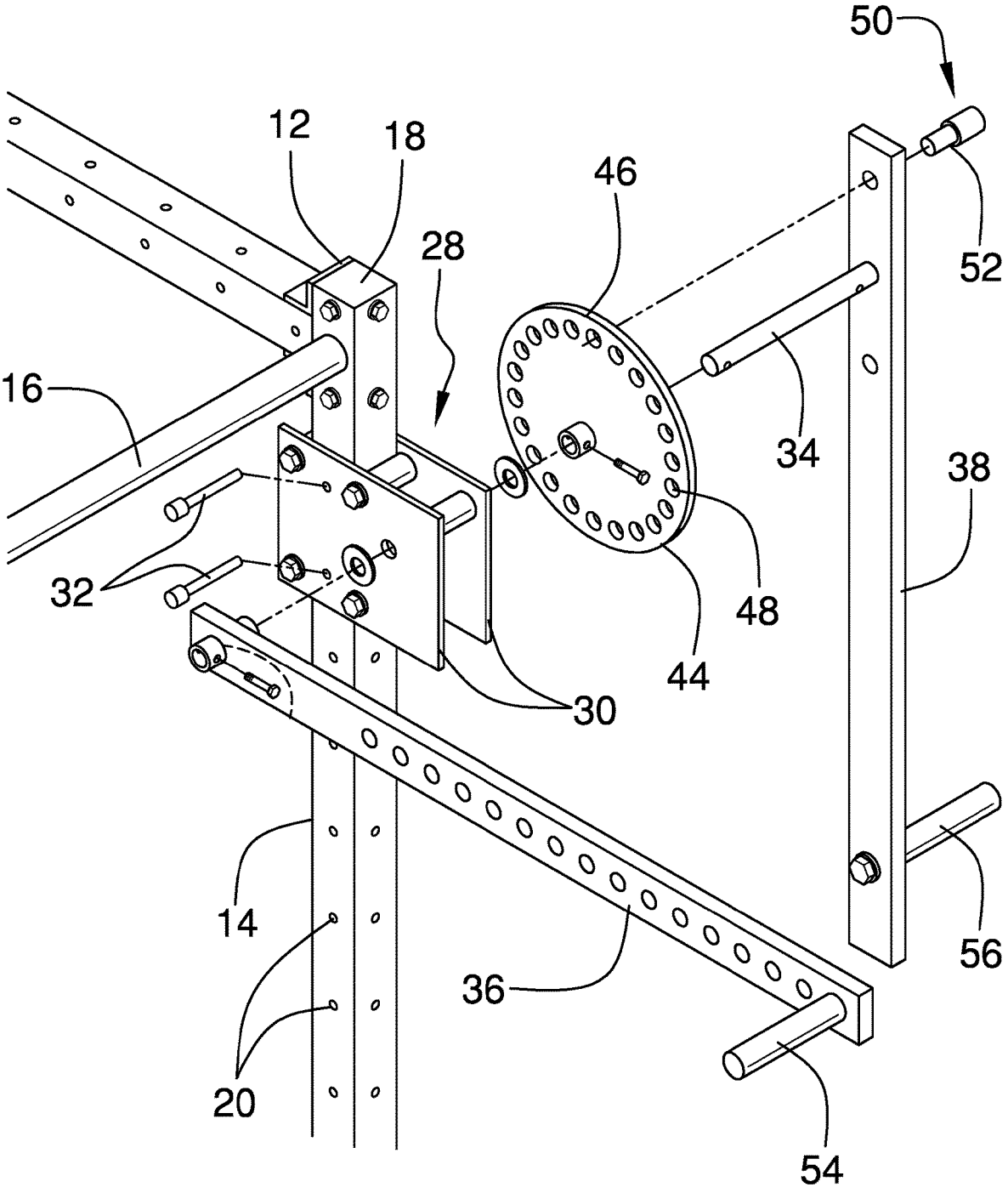
FIG. 6 is an exploded isometric view of an embodiment of the disclosure.
Figure 7:
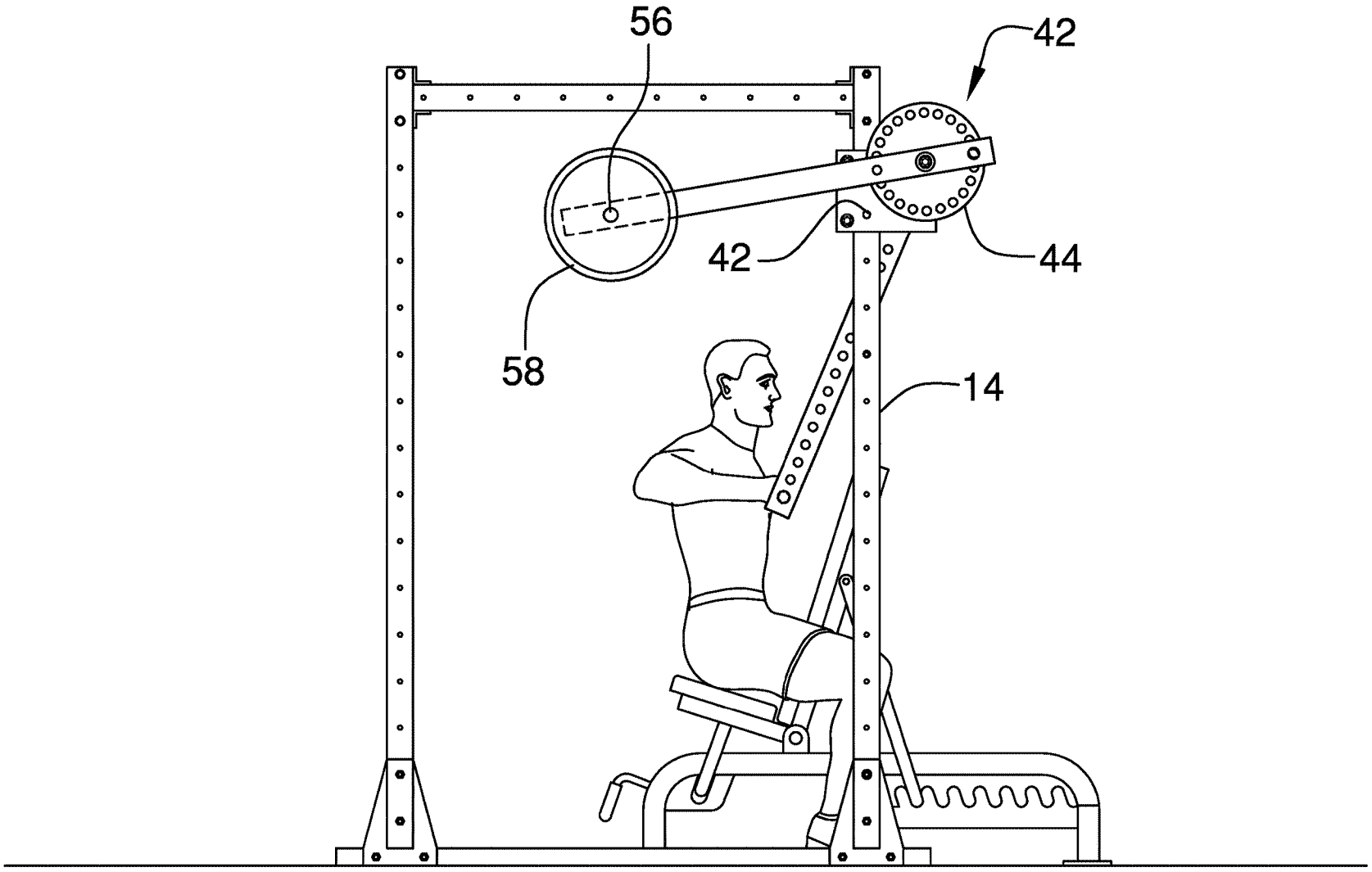
FIG. 7 is a side in-use view of an embodiment of the disclosure.

Each of the lifting assemblies 26 includes a mount 28 which releasably engages one of the columns 14. In some embodiments, the mount 28 generally extends around the associated one of the columns 14. As shown in FIG. 1, the mount 28 may include a pair of outer walls 30 positioned laterally to and on opposite sides of an associated one of the columns 14. The outer walls 30 are attached to each other and a pin 32 extends through the outer walls 30 and through one of the apertures 20 to releasably secure the mount 28 to the associated one of the columns 14. By removing the pin 32, the mount 28 can be moved upwardly and downwardly along the columns 14 to alter the height of the lifting assemblies 26 and accommodate different exercises to be performed by a user of the system 10. Alternate locking structures are known within the weightlifting arts that may be used for releasably securing a mount 28 to squat rack type frames. It should be understood that more than one pin 32 may be utilized as is shown in FIG. 6.

Figure 8:
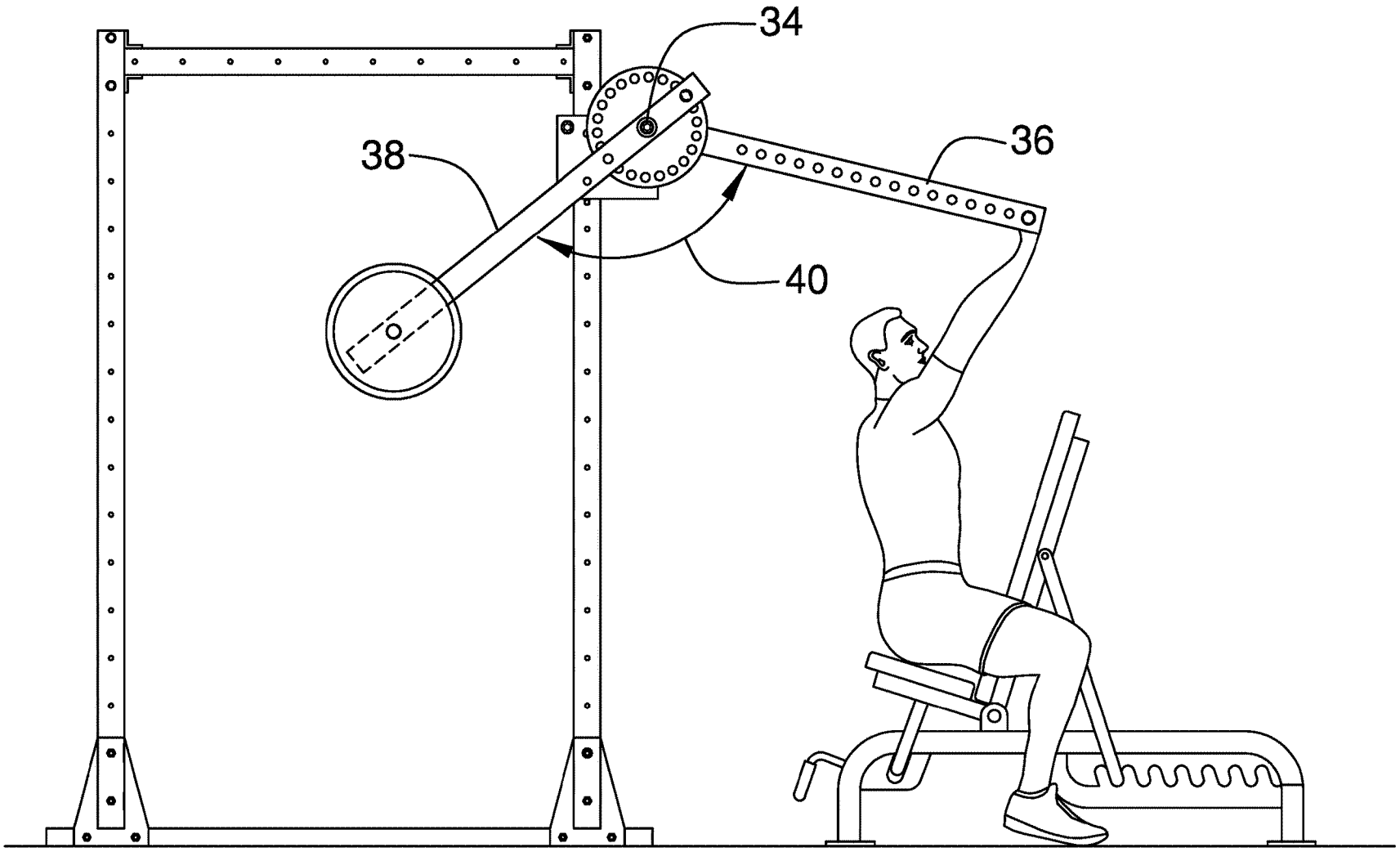
FIG. 8 is a side in-use view of an embodiment of the disclosure.
Figure 9:
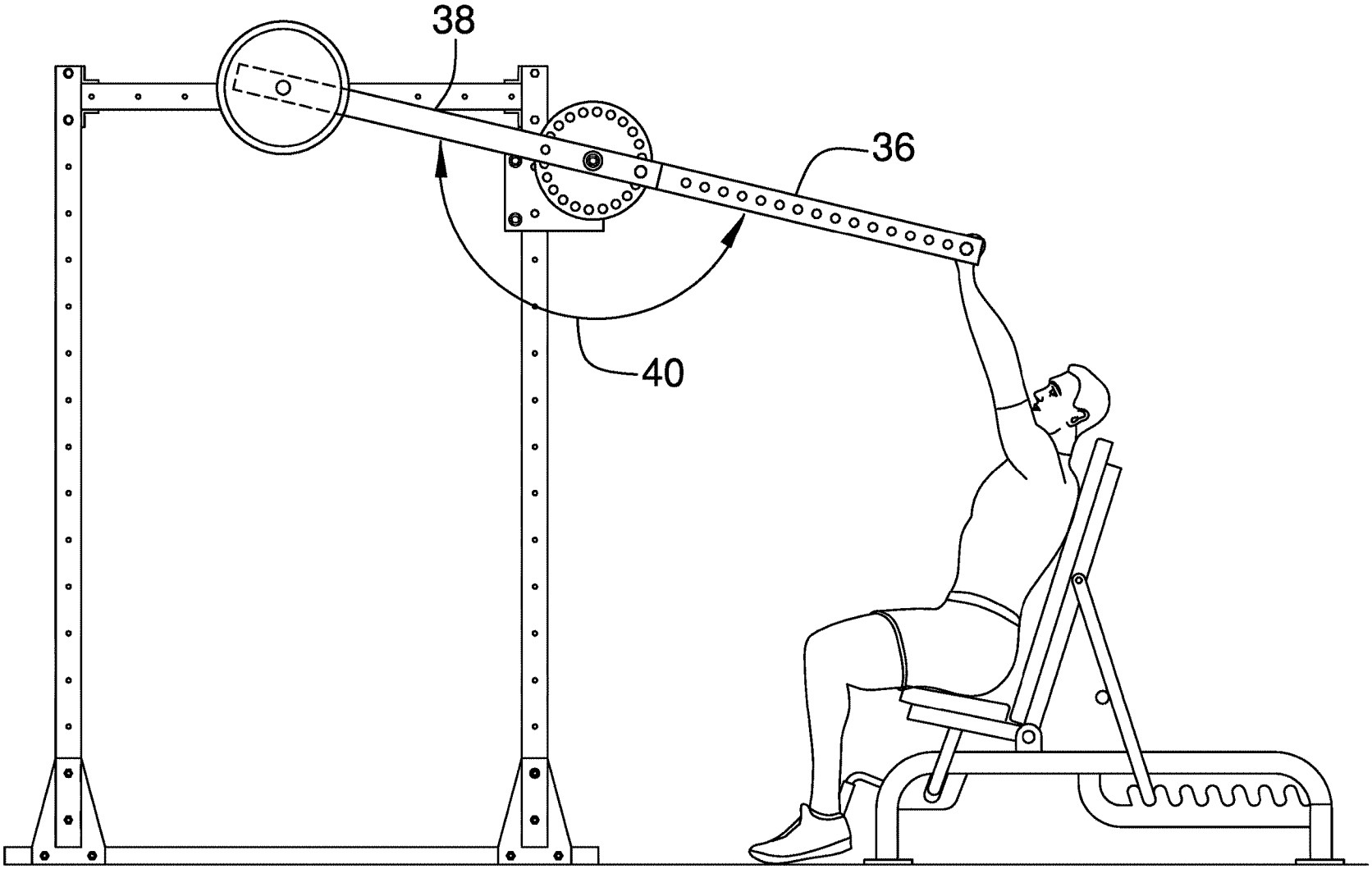
FIG. 9 is a side in-use view of an embodiment of the disclosure.

An axle 34 extends through the mount 28 and is rotational relative to the mount 28. The axle 34 is elongated and has a rotational axis extending along is length. Though not essential, the rotational axis will typically be horizontally orientated and be perpendicular to a longitudinal axis of each of the columns 14 which are most typically vertically orientated. A first arm 36 is fixedly attached to the axle 34 such that movement of the first arm 36 rotates the axle 34. The term "fixedly" herein use generally to define a static coupling and does not require the first arm 36 to be non-removably attached to the axle 34. A second arm 38 is rotationally coupled to the axle 34 such that the second arm 38 can rotate freely around the axle 34 without causing movement of the first arm 36. A lift angle 40, as shown in FIG. 8, is defined between the first 36 and second 38 arms wherein the axle 34 defines a vertex of the lift angle 40. Since the second arm 38 can rotate freely of the axle 34, the lift angle 40 is alterable from 0° to 180° in both directions. That is, the lift angle may be measured between −180° and 180°. The lift angle 40 is approximately 70° in FIG. 7, 0° in FIG. 10, 10° in FIG. 11, and 135° in FIG. 8.

A locking member 42 releasably locks the second arm 38 with respect to the axle 34 such that the lift angle 40 is releasably retained at a selected measurement. In one embodiment, the locking member 42 comprises a plate 44 that is mounted onto and fixedly coupled to the axle 34. The plate 44 lies in a plane orientated perpendicular to the axis of rotation of the axle 34. The plate 44 has a perimeter edge 46 and a plurality of receivers 48 extend into the plate 44. In some embodiments, the plate 44 is circular and the receivers 48 comprise openings extending through the plate 44. The receivers 48 will typically be equidistance from the axle 34 and positioned adjacent to the perimeter edge 46. A coupler 50 engages the second arm 38 and is releasably engaged with one of the receivers 48 to lock the second arm 38 relative to the plate 44, and thereby lock a position of the second arm 38 relative to the axle 34 and the first arm 36. The coupler 50 may comprise a rod 52, or a plurality of rods 52, extending through the second arm 38 and into one of the receivers 48.

A handle 54 and a weight receiver 56 are each provided for each lifting assembly 26. One of the first 36 and second 38 arms has the handle 54 attached thereto and the other of the first 36 and second 38 arms has the weight receiver 56 attached thereto. The hand 54 is used for gripping the lifting assembly 26 by a user of the system 10. The handle 54 extends inwardly toward the other one of the lifting assemblies 26 and the weight receiver 56 extends outwardly away from the other one of the lifting assemblies 26. Which of the first 36 and second 38 arms includes handle 54 or weight 56 receiver will not affect the operation of the system 10. Since each lift assembly 26 includes one first arm 36 and one second arm 38, one of the first 36 and second 38 arms will be positioned inside of column 14 to which it is attached, and one of the first 36 and second 38 arms will be positioned outside of that column 14. The term "inside" as used herein is intended to define as being between the columns 14. Moreover, functionality is not affected by which of the outside or inside arms is the one which is fixed versus rotatable relative to the axle 34. Finally, some embodiments may place both arms 36, 38 outside or inside of the columns 14.

In one embodiment, shown in the Figures, the handle 54 is attached to first arm 36 and the first arm 36 is positioned between the columns 14. In this embodiment, the weight receiver 56 is attached to the second arm 38 and is positioned outside of the columns 14 and the plate 44 is positioned between the frame 12 and the second arm 38. Conventional weight plates 58 include a central opening for receiving a typical weightlifting bar. The weight receiver 56 therefore may comprise a shaft onto which one or more weight plates 58 is positioned.

The first 36 and second 38 arms each form a fixed angle relative to the axle 34. The fixed angle is between 60° and 120°. That is, at the point where each of the first 36 and second 38 arms extend away from the axle 34 will form an angle between 60° and 120°. However, the first 36 and second 38 arms will often form a 90° with the axle 34 as is apparent in FIG. 4. The first 36 and second 36 arms may include bends therein, as opposed to being straight as shown in the Figures, to better position the handles 54 or weight plates 58 nearer or farther away from each other to prevent interference with a user of the system 10 or with the columns 14.

Figure 10:
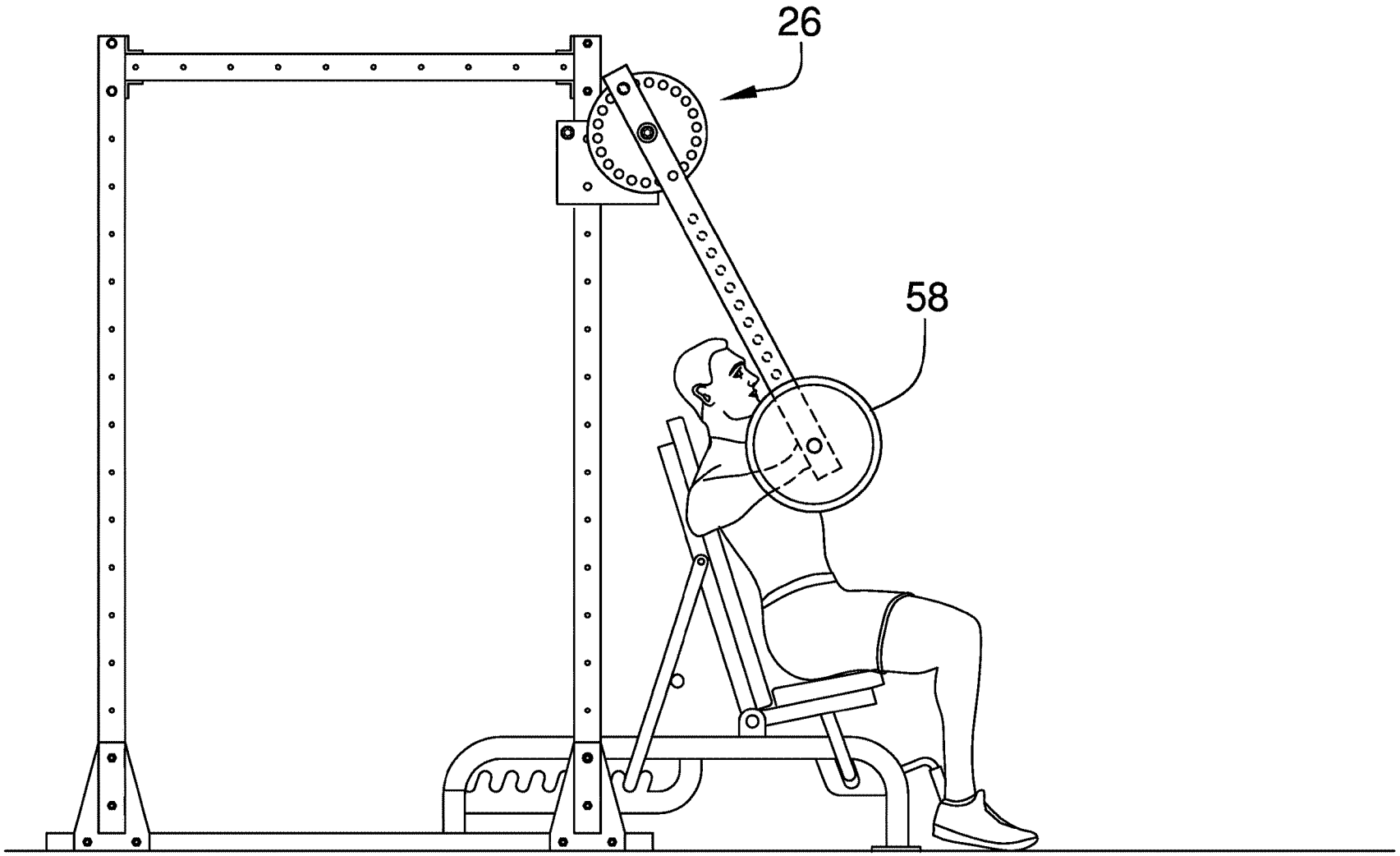
FIG. 10 is a side in-use view of an embodiment of the disclosure.
Figure 11:
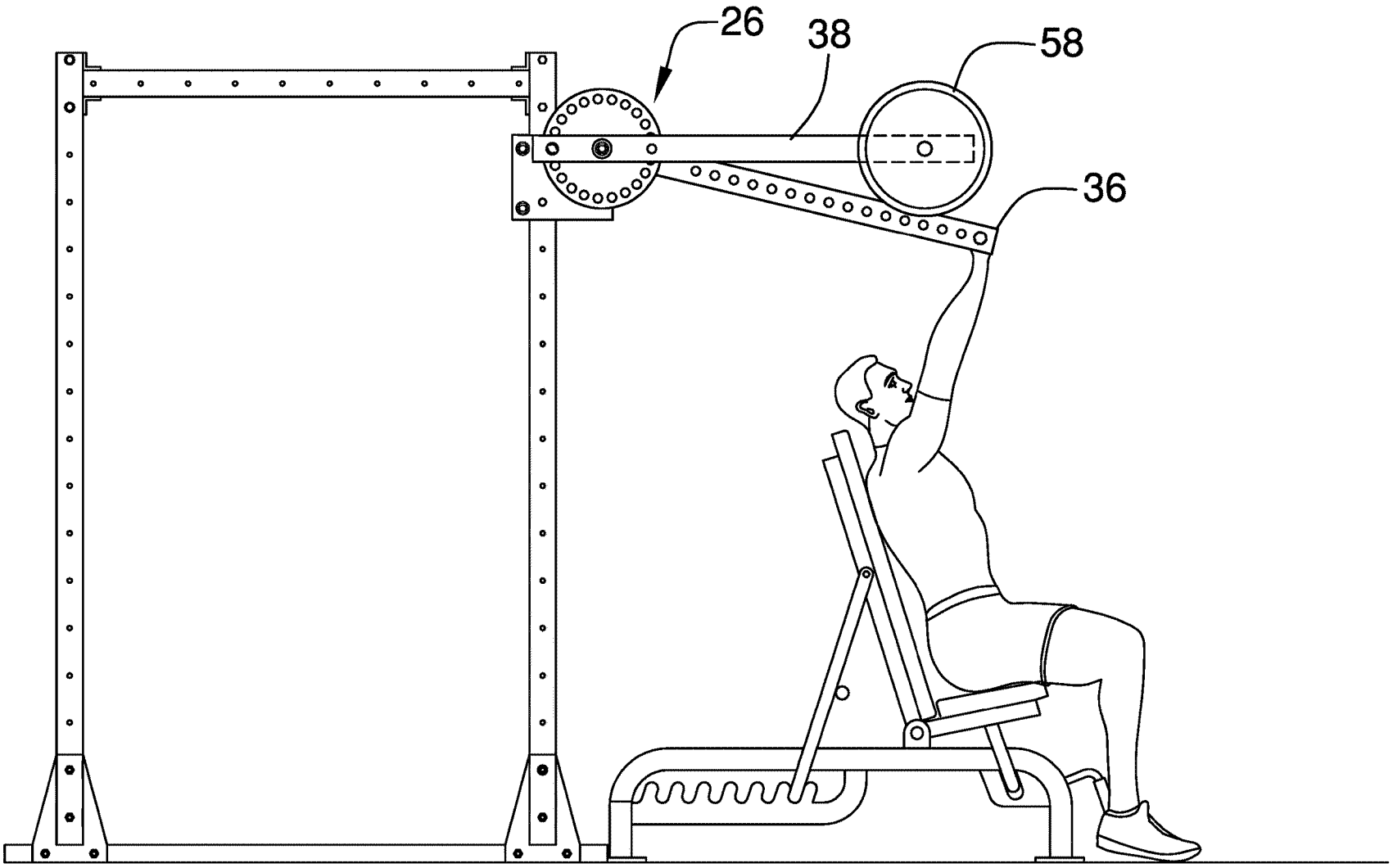
FIG. 11 is a side in-use view of an embodiment of the disclosure.
Figure 12:
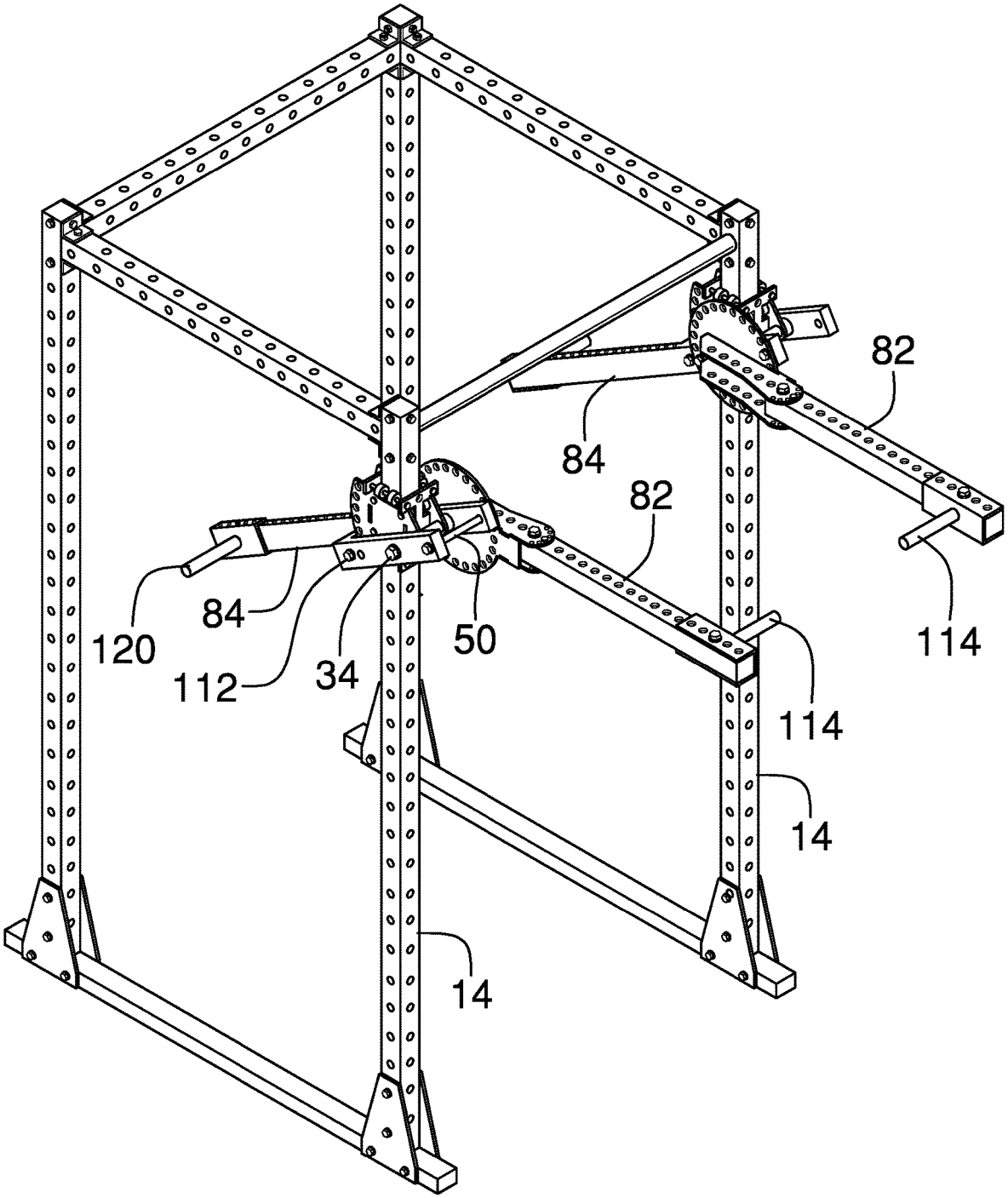
FIG. 12 is a front isometric view of another embodiment of a weightlifting exercising system according to an embodiment of the disclosure.
Figure 13:
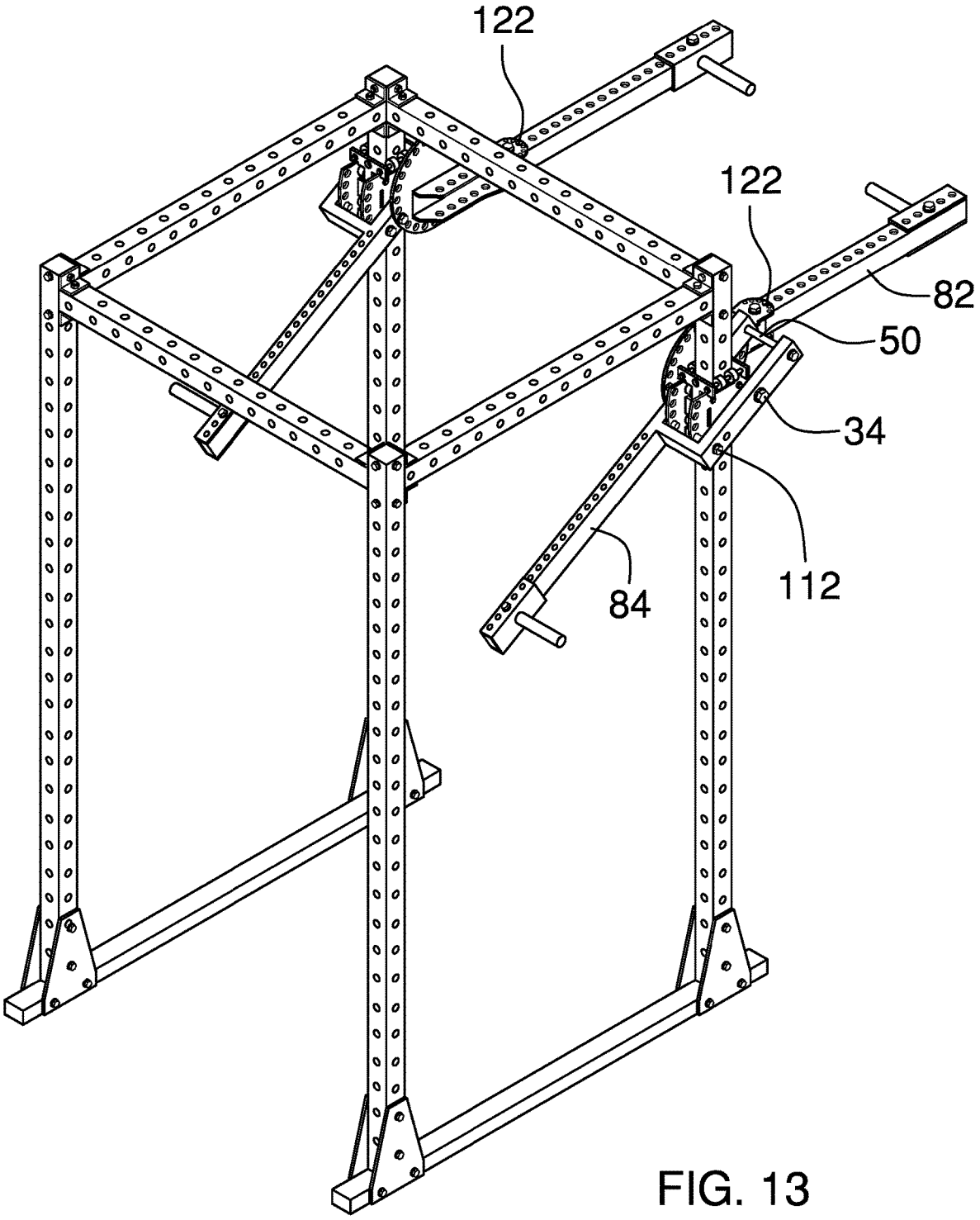
FIG. 13 is a rear isometric view of an embodiment of the disclosure shown in FIG. 12.

Generally, during use, system 10 allows a person performing exercises to utilize a squat rack, i.e. frame 12, to perform multiple different exercises by altering the vertical location of the lift assemblies 26 on the columns 14 and by altering the lift angle 40. For example, the lift assemblies 26 may be lowered to lower position such that a person lying on a bench will utilize a 0° lift angle and lift the weight plates upwardly in a conventional bench press type exercise to exercise the pectoral muscles. A similar exercise may be achieved with a 90° lift angle wherein the user faces away from the frame and sits up, the first arms 36 extend down, and the second arms 38 extend forward. Thus, when the first arms 36 are pushed forward the user will receive an upper pectoral exercise. Location of the bench will also affect the exercise as FIG. 10 is a pectoral exercise while FIG. 11 exercises the shoulders. The user may also use a greater lift angle 40 such as in FIG. 8 and then pull down the first arms 36 for back exercises, or the user may be seated and while facing a backrest of the bench and the frame 12 to pull the first arms 36, which are extending downwardly, toward the user. Other exercises including different squatting, bicep and triceps exercises may be performed as well as other variations of all exercises requiring either the pulling or pushing of weight. The point of greatest force may be altered by the changing of the lift angle 40 such that the relative position of the weight plates 58 to the axle 34 is altered.

Though not shown, stops may be incorporated with the system 10, such as which engage the axle 34, the first 36 or second 38 arms, the column 14, or the mount 28 to releasably prevent movement of the weight receiver 56 and second arm 38 beyond a particular level. For example, in the embodiment of FIG. 8, this may include a stop positioned on the mount 28 or the column 14 to prevent the second arm 38 from swinging toward the user.

Figure 14:
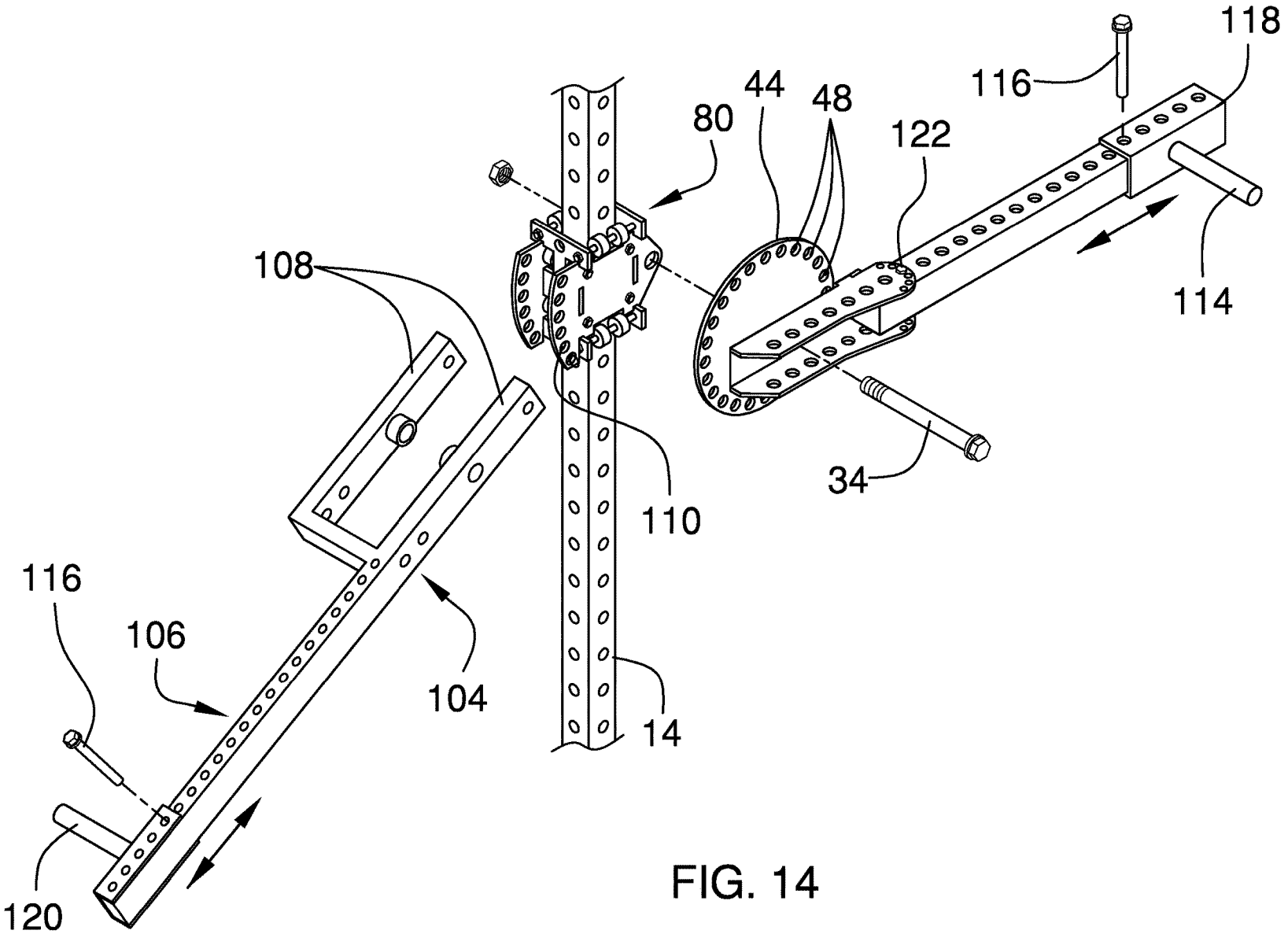
FIG. 14 is an exploded, side isometric view of an embodiment of the disclosure shown in FIG. 12.
Figure 15:
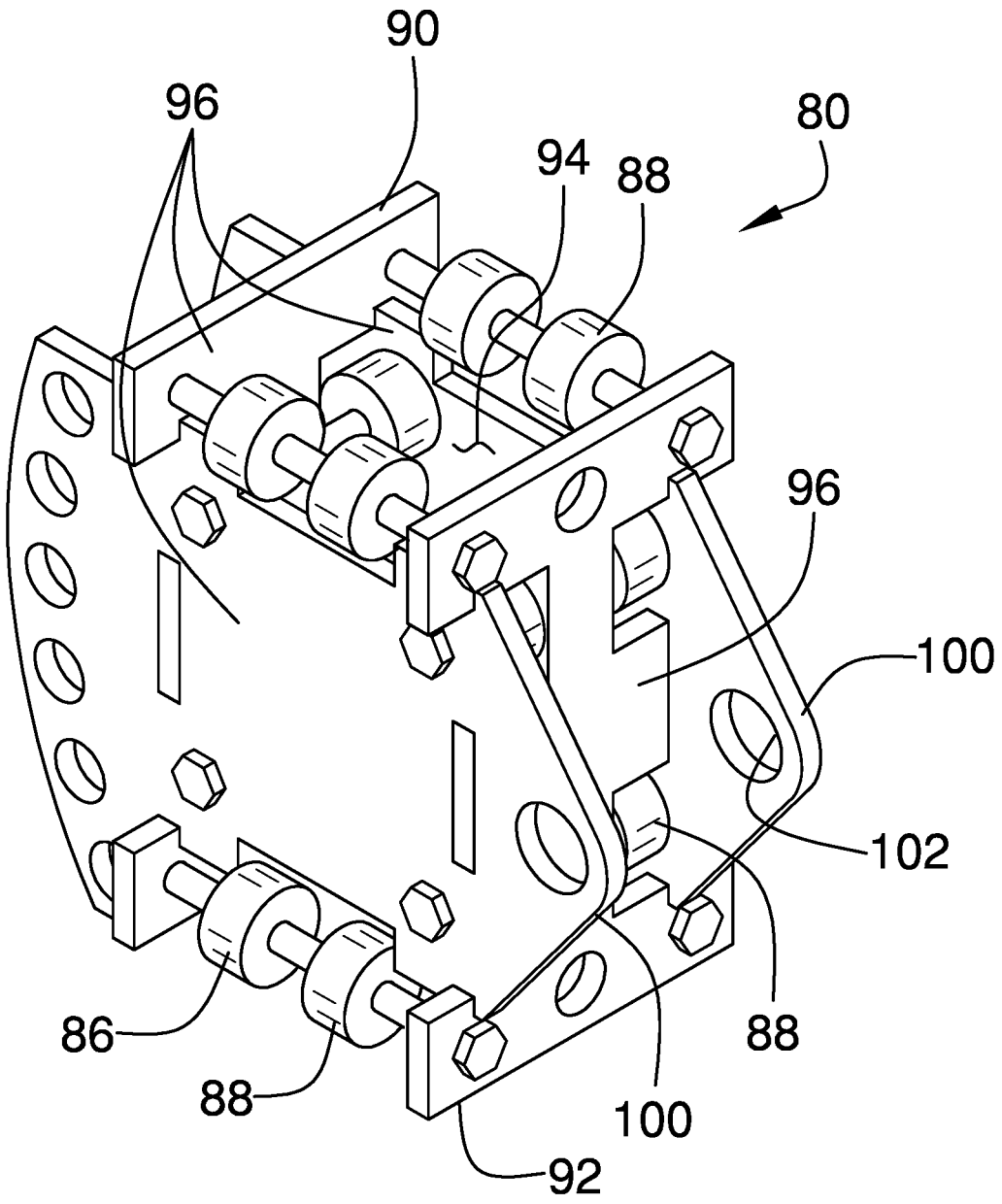
FIG. 15 is a front isometric view of a mount of an embodiment of the disclosure shown in FIG. 12.
Figure 16:
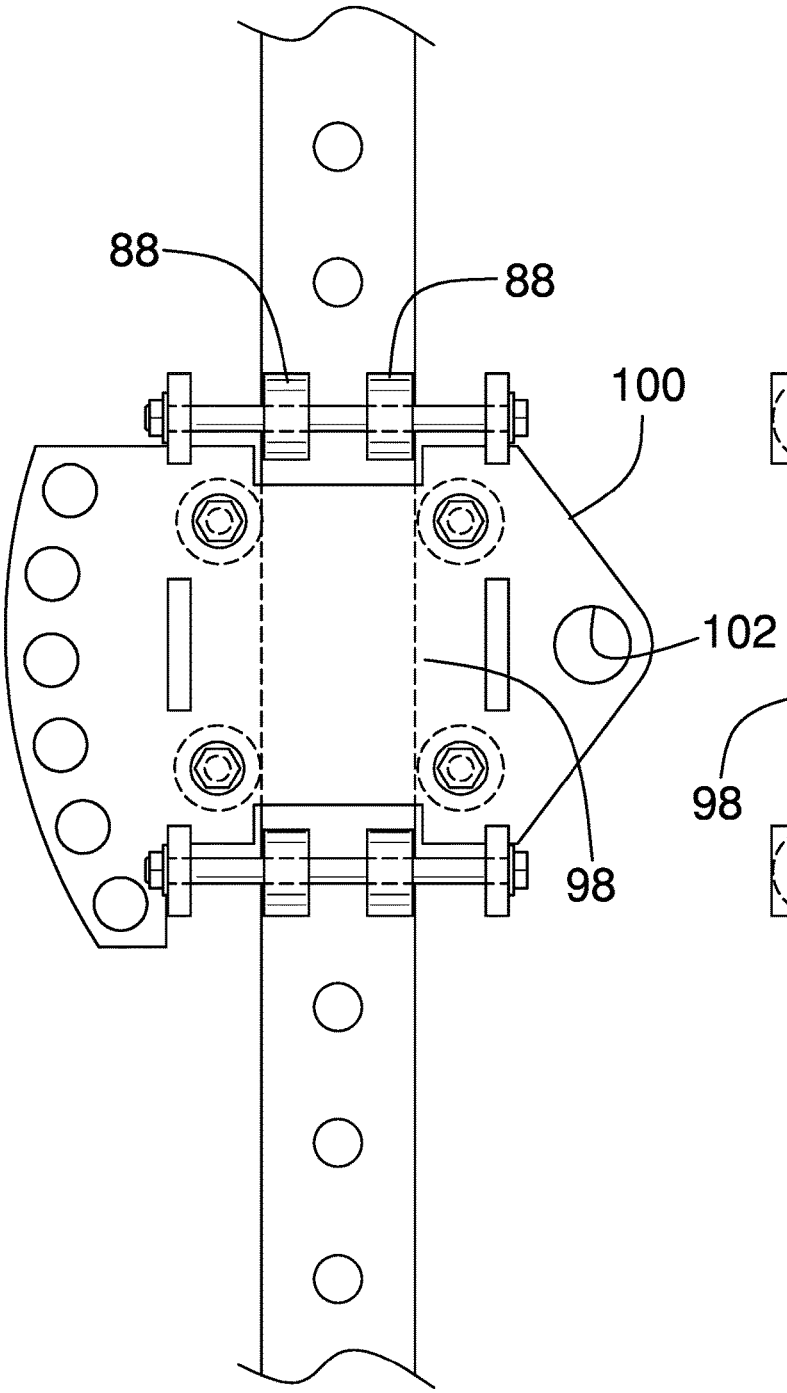
FIG. 16 is a side view of an embodiment of the mount of the disclosure shown in FIG. 12.
Figure 17:
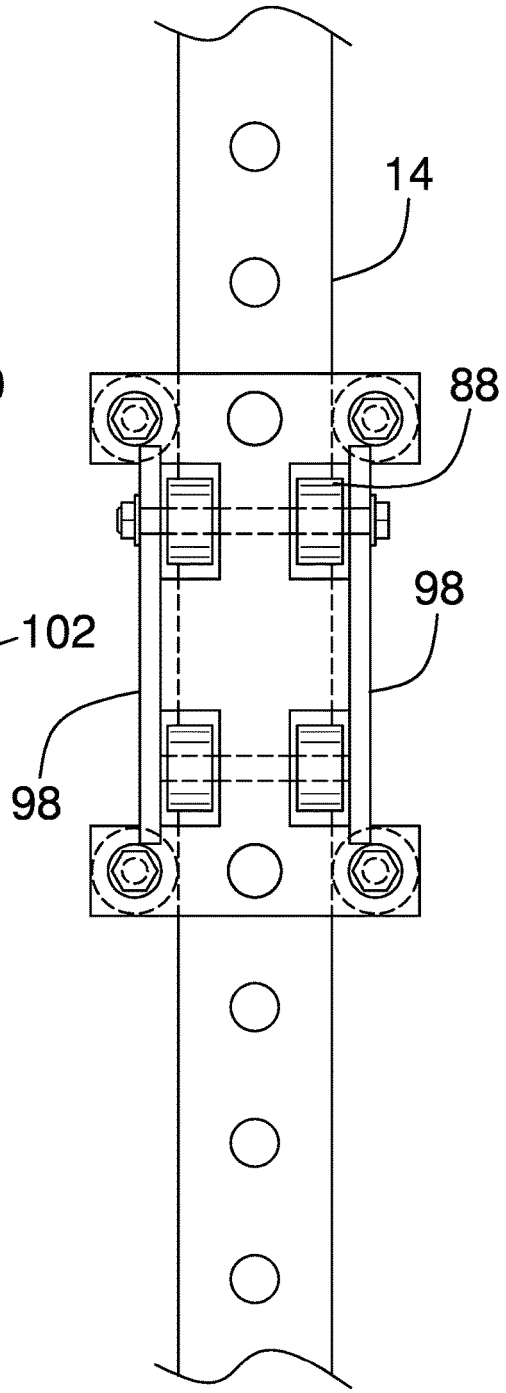
FIG. 17 is a rear view of an embodiment of the mount of the disclosure shown in FIG. 12.
Figure 18:
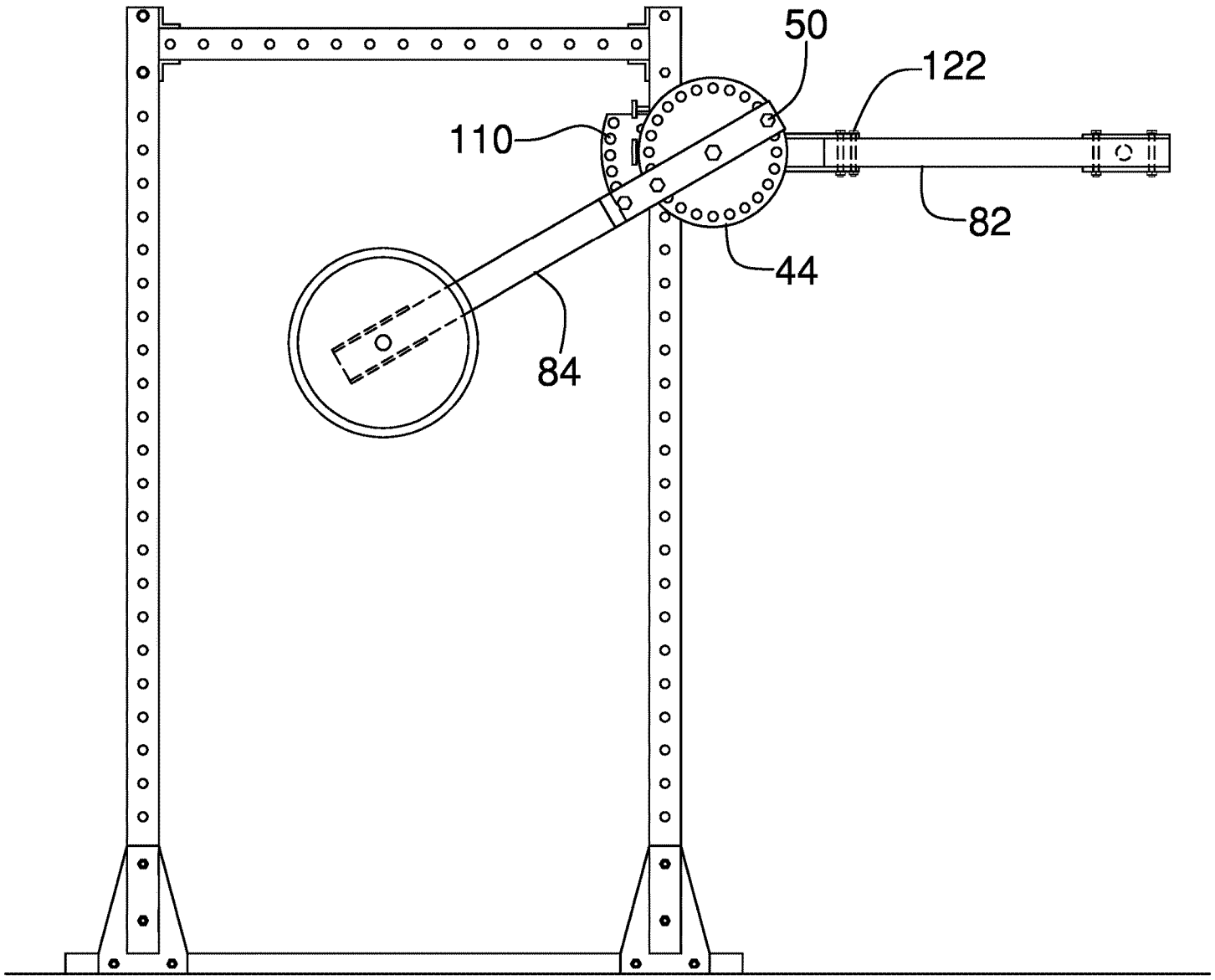
FIG. 18 is a side view of the embodiment of the disclosure shown in FIG. 12.

Another embodiment depicted in FIGS. 12 through 18 includes a mount 80 and first 82 and second 84 arm variations that may be utilized in a generally similar manner to the version shown in FIGS. 1-11. In this embodiment, the mount 80 comprises a sleeve 86 extending around a column 14 and including rollers 88, which may comprise wheels, bearings, or other spinning/rotatably contacts, rotatably coupled to the mount 80 and positioned between the mount 80 and the column 14. The rollers 88 abut the column 14 such that the mount 80 more easily travels upwardly and downwardly along the column 14. As can be seen in the Figures, the mount 80 includes an open top end 90 and an open bottom end 92 each being open for receiving the column 14. Between the top 90 and bottom 92 ends is an interior surface 94 comprising four side walls 96. Each of the side walls 96 includes one or more rollers 88 having being able to rotate about a horizontal axis. In one embodiment, as shown in FIG. 15, each side wall 96 of the mount 80 includes a pair of rollers 88 mounted adjacent to the top end 90 and a pair of rollers 88 mounted adjacent to the bottom end 92.

The mount 80 includes a pair of lateral walls 98 which correspond to the outer walls 30 of the embodiment described above. Each of the lateral walls 98 includes a pair of flanges 100 each extending in a same direction with respect to each other. The flanges 100 lie in vertical planes orientated perpendicular to the axle 34 and each includes an axle opening 102 for receiving the axle 34. The locking assembly 26 includes the plate 44 being statically coupled to the first arm 82 and the axle 34 extends through the plate 44, the first arm 82 and the second arm 84. The coupler 50 extends through a selected one of the receivers 48 in the plate 44 and through the second arm 84 to adjust the angle of the second arm 84 relative to the first arm 82. As can be seen in FIG. 14, the second arm 84 may have a proximal portion 104 and a distal portion 106 with respect to the axle 34 wherein the distal portion 106 is a single elongated member and wherein the proximal portion 104 forms a pair of fingers 108 having a space between them. The mount 80 is positioned between the fingers 108 and each of the coupler 50 and the axle 34 extends through both fingers 108. This structure more evenly distributes the amount of force across the mount 80 and the first 82 and second 84 arms. The mount 80 may include locking apertures 110 wherein a pin 112 is extendable through one of the locking apertures 110 and the fingers 108 to prevent movement of the second arm 84 relative to the column 14 such as when loading weight plates 58.

FIG. 14 additionally shows a handle 114 movably positioned on the first arm 82 for allowing the handle 114 to be moved closer to, or farther away from, the axle 34. In this embodiment, a pin 116 extends through a slide 118 on which the handle 114 is mounted and through one of a plurality of holes extending through and along a length of the first arm 82. In a similar manner the weight receiver 120 of FIG. 14 may also be movable along the length of the second arm 84 and secured in place with a pin 116. The ability to move the handle 114 and weight receiver 120 will understandably facilitate the ability to alter the amount of weight being lifted as well as the amount of movement encountered during a particular exercise. The first arm 82 may additionally include a break to allow an angle of the first arm 82 to be altered to move the handle 114 laterally relative to the column 14. A pin 122 extending through sections of the first arm 82 to retain a bend in the first arm 82 at a selected angle.

Figure 19:
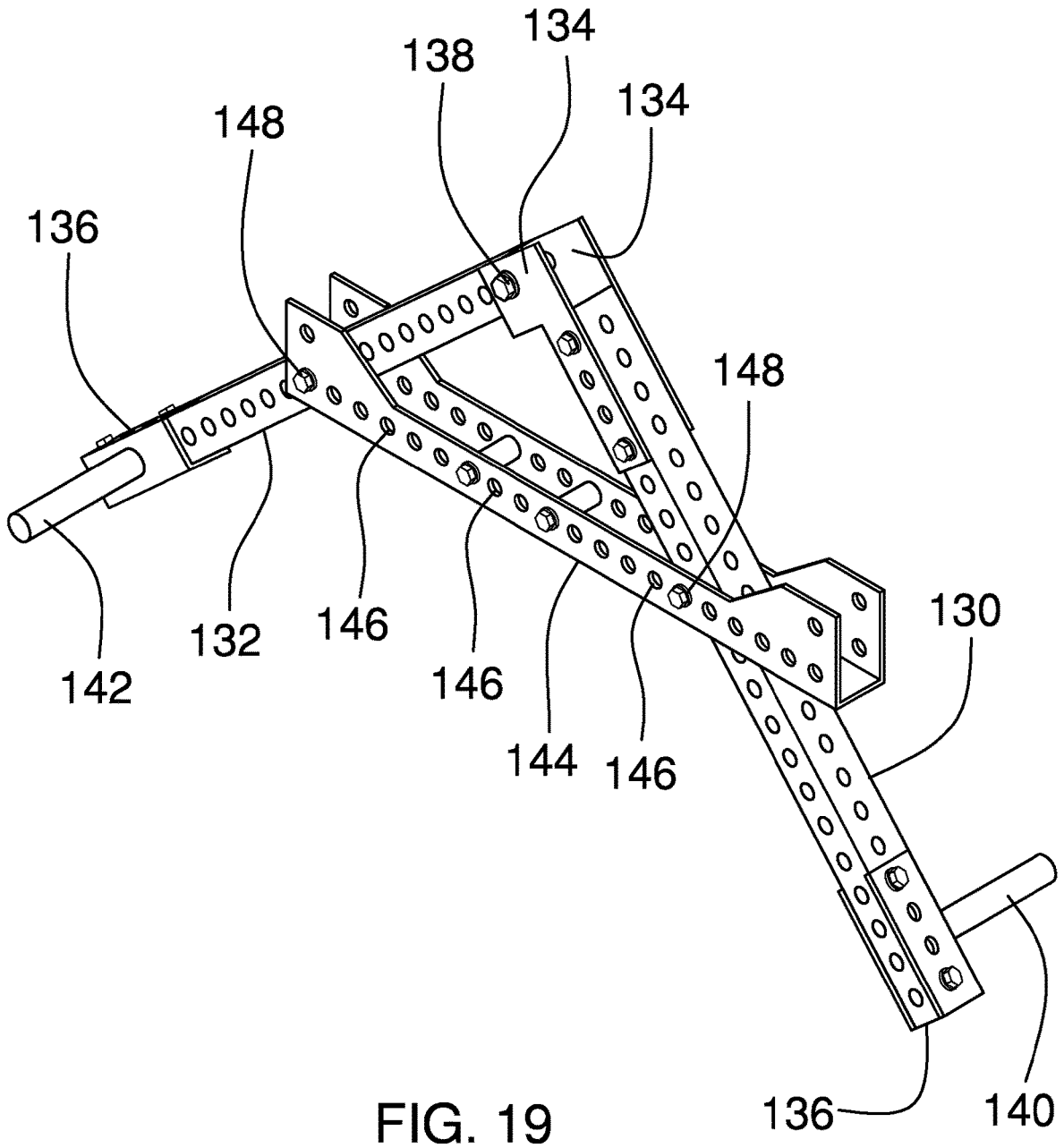
FIG. 19 is a side isometric view of a third embodiment of the disclosure.
Figure 20:
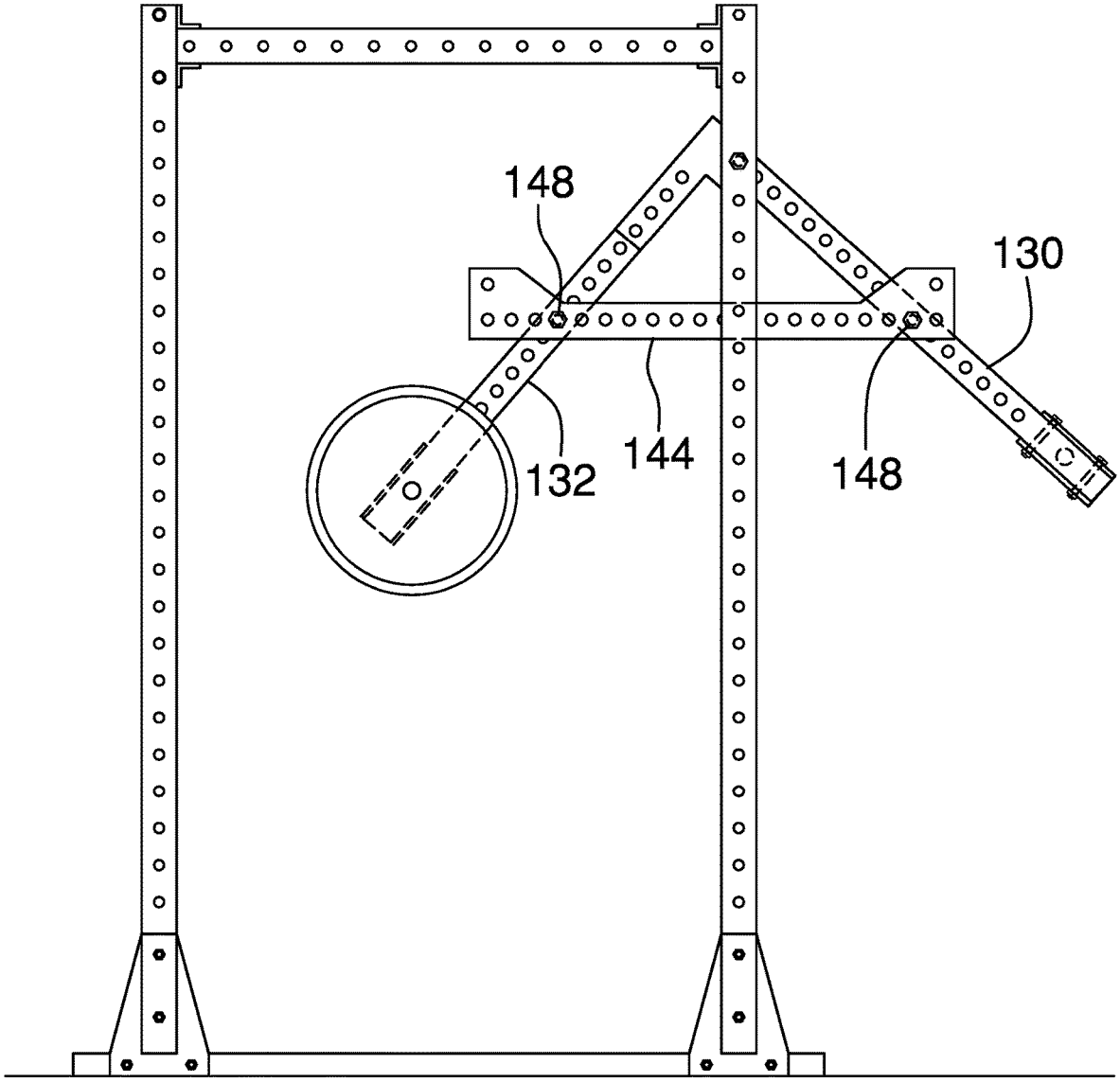
FIG. 20 is a side view of the fourth embodiment of the disclosure.
Figure 21:
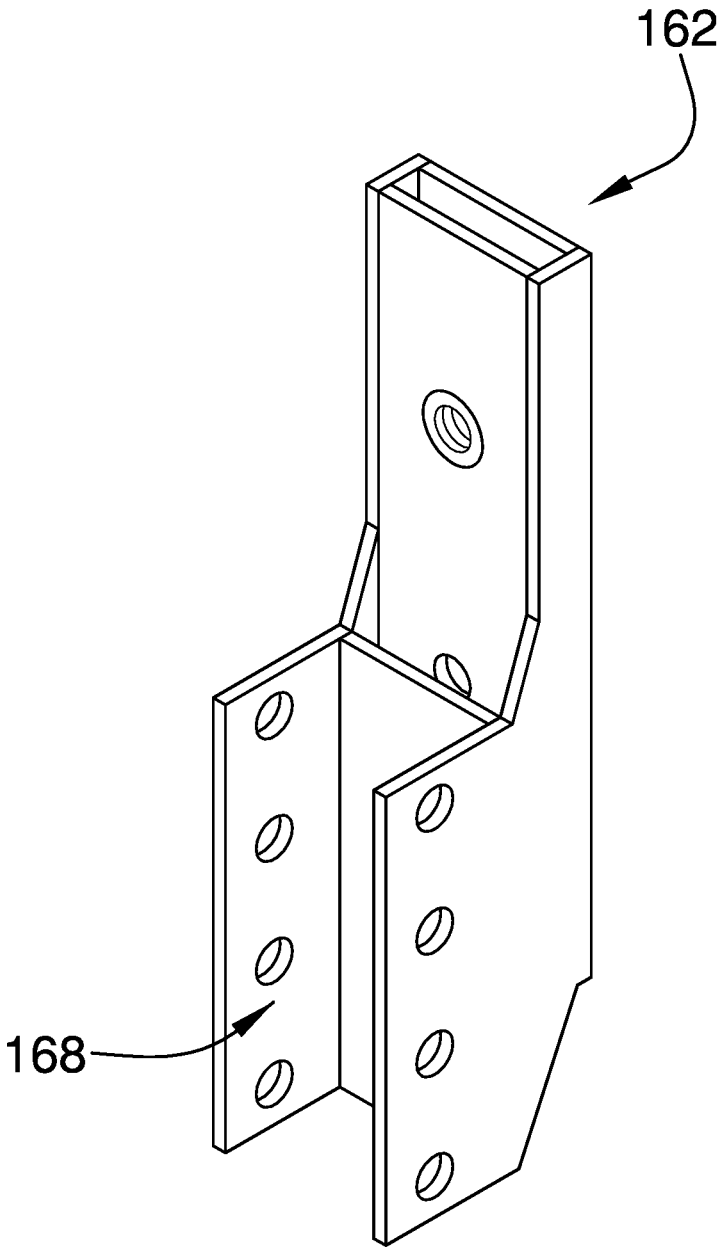
FIG. 21 is a front isometric view of a mount of an embodiment of the disclosure.
Figure 22:
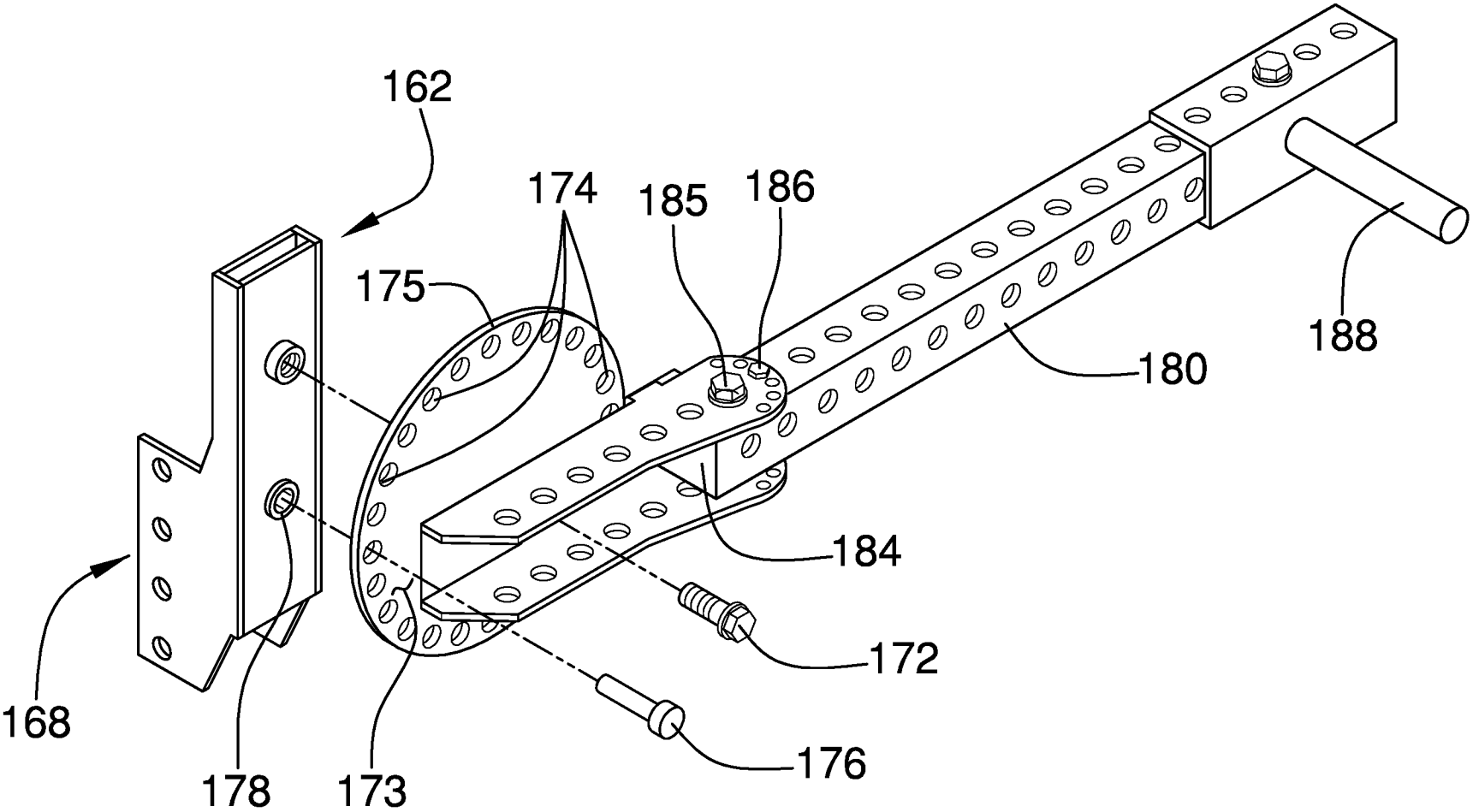
FIG. 22 is a front isometric view of an embodiment of the mount of the disclosure shown in FIG. 21.
Figure 23:
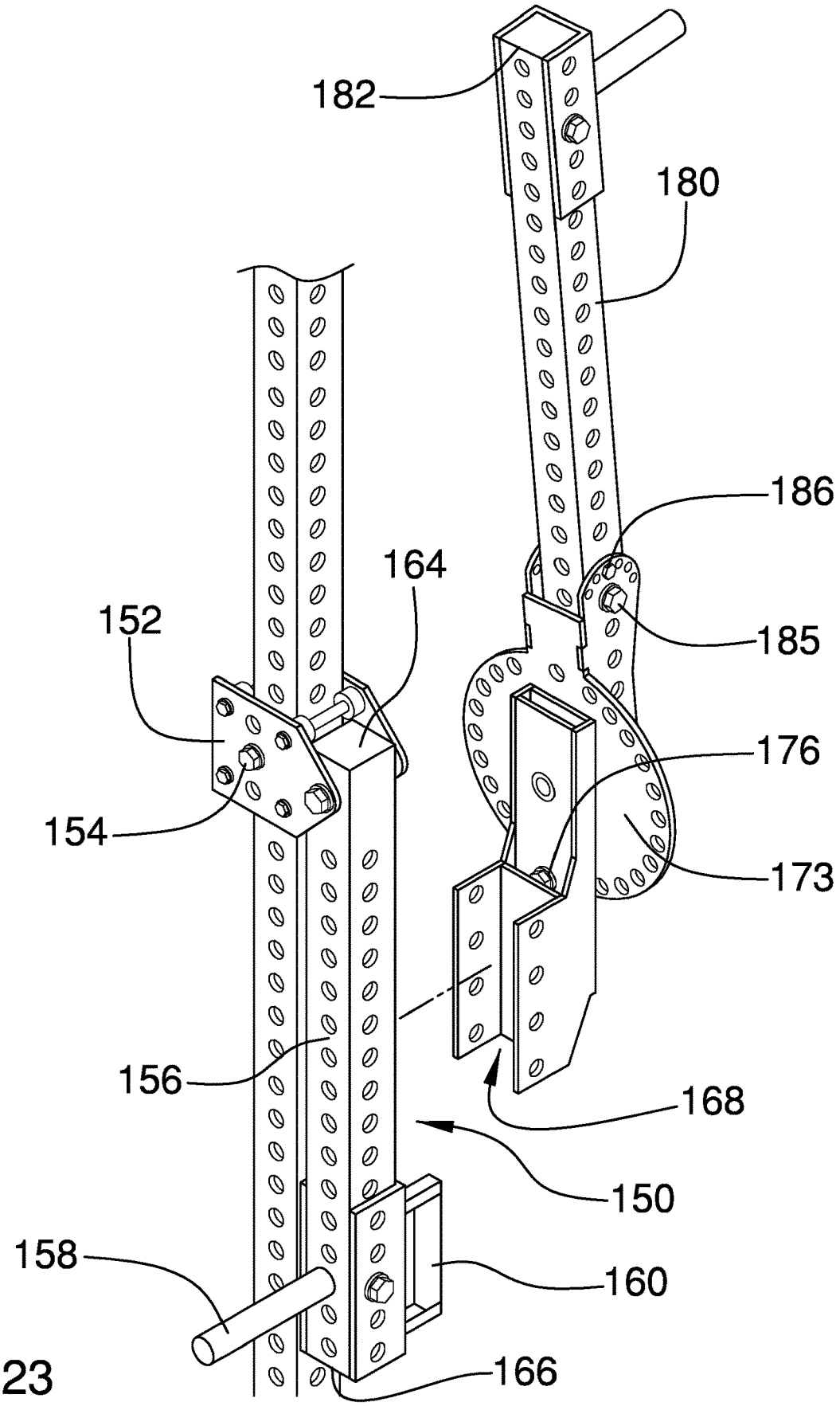
FIG. 23 is a front isometric view of an embodiment of the mount and a lever arm of the disclosure shown in FIG. 21.
Figure 24:
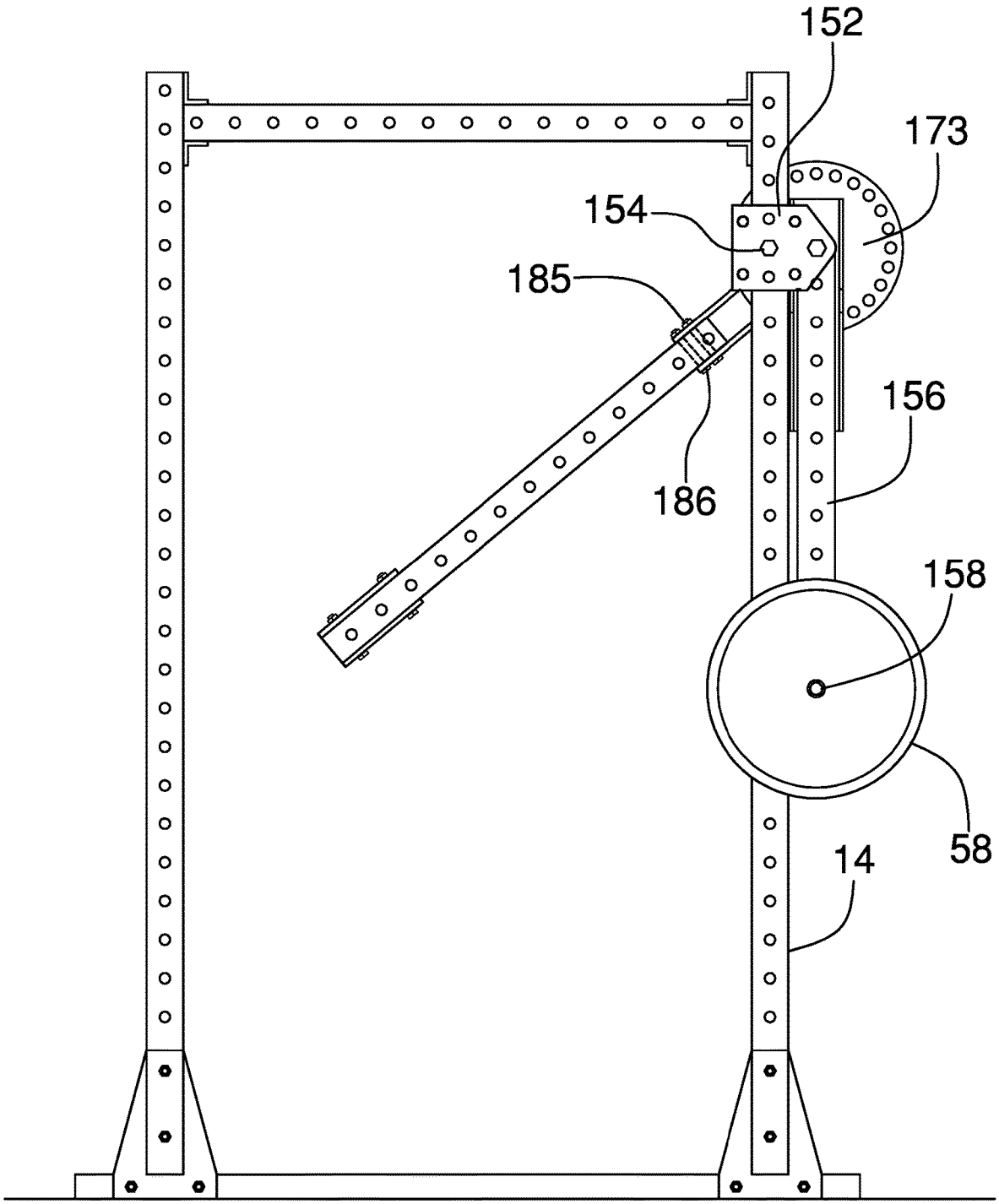
FIG. 24 is a side view of the embodiment of the disclosure shown in FIG. 23.

FIGS. 19 and 20 demonstrate an embodiment which still include a first arm 130 and a second arm 132 each having a first end 134 and a second end 136. Their first ends 134 are pivotally coupled together with an axle 138 extending through the column 14. The handle 140 and weight receiver 142 are each positioned or positionable adjacent to the second ends 136. However, instead of a plate 44 as utilized in the above embodiments, a brace 144 is provided through which extends, spaced along its length, a plurality of coupling points 146. The coupling points 146 comprise holes alignable with selected ones of the holes in the first 134 and second 136 arms. As should be readily understood, a user of this embodiment may easily alter the angle between the first 134 and second 136 arms by selecting different connection locations between the brace 144 and the first 134 and second 136 arms and extending rods 148 through aligned ones of the coupling points 146 and holes in the first 134 and second 136 arms.

Another embodiment of the system 10 depicted in FIGS. 21-25 provides a structure that is used with what are conventionally known as a lever arms 150. Lever arms 150 are used on a column 14 of squat rack for lifting of a weight plate 58 in a single, vertical direction. As can be seen in the Figures, the lever arm 150 includes a connector 152 for mounting on the column 14 and which can be moved vertically along the column 14 in a conventional manner with locking pins 154. A leverage arm 156 is pivotally attached to the connector 152 such that the leverage arm 156 is pivotal only in a vertical plane. That is, the leverage arm 156 allows for lifting, either by pushing or pulling, of the weight plate 58 upwardly. A weight receiver 158 is positioned distal to the connector 152 and is configured to releasably engage one or more weight plates 58. A grip 160 is attached to the leverage arm 156 adjacent to the weight receiver 158. Typical lever arms 150 may also allow the grip 160 to be movable along the leverage arm 156 to attach the leverage arm 156 where desired.

This embodiment includes a mount 162 that, instead of engaging the column, releasably engages the leverage arm 156. This allows retrofitting of the system 10 to the lever arm 150 in such a manner that the leverage arm 156 functions as one of the first 82 or second 84 arms of the other embodiments. The mount 156 is positionable between a pivot end 164 of the leverage arm 156 and a weight end 166 of the leverage arm 156 and may be selectively movable to allow for adjustments in total movement of the weight plate 58 during an exercise as well as altering the center of gravity relative to the weight plate(s) 58. The mount 162 includes a saddle 168 for receiving the leverage arm 156. At least one fastener 170 is extendable through the saddle 168 and the leverage arm 156 to releasably secure the mount 162 to the saddle 168. The leverage arm 156 will typically have a plurality of aligned apertures for the selective placement of the mount 156 and the fastener 170.

A spindle 172 extends through the mount 162 and has an axis orientated perpendicular to the vertical plane. A plate 173 is rotatably mounted on the spindle 172. The plate 173 is releasably restrained with respect to the mount 162 to retain the plate 173 at a selected rotational position relative to the mount 162. This may be accomplished with the plate 173 having a plurality of receivers 174 positioned adjacent to its perimeter edge 175. A rod 176 is extendable through one of the receivers 174 and into an aligned opening 178 extending into the mount 162.

Figure 25:
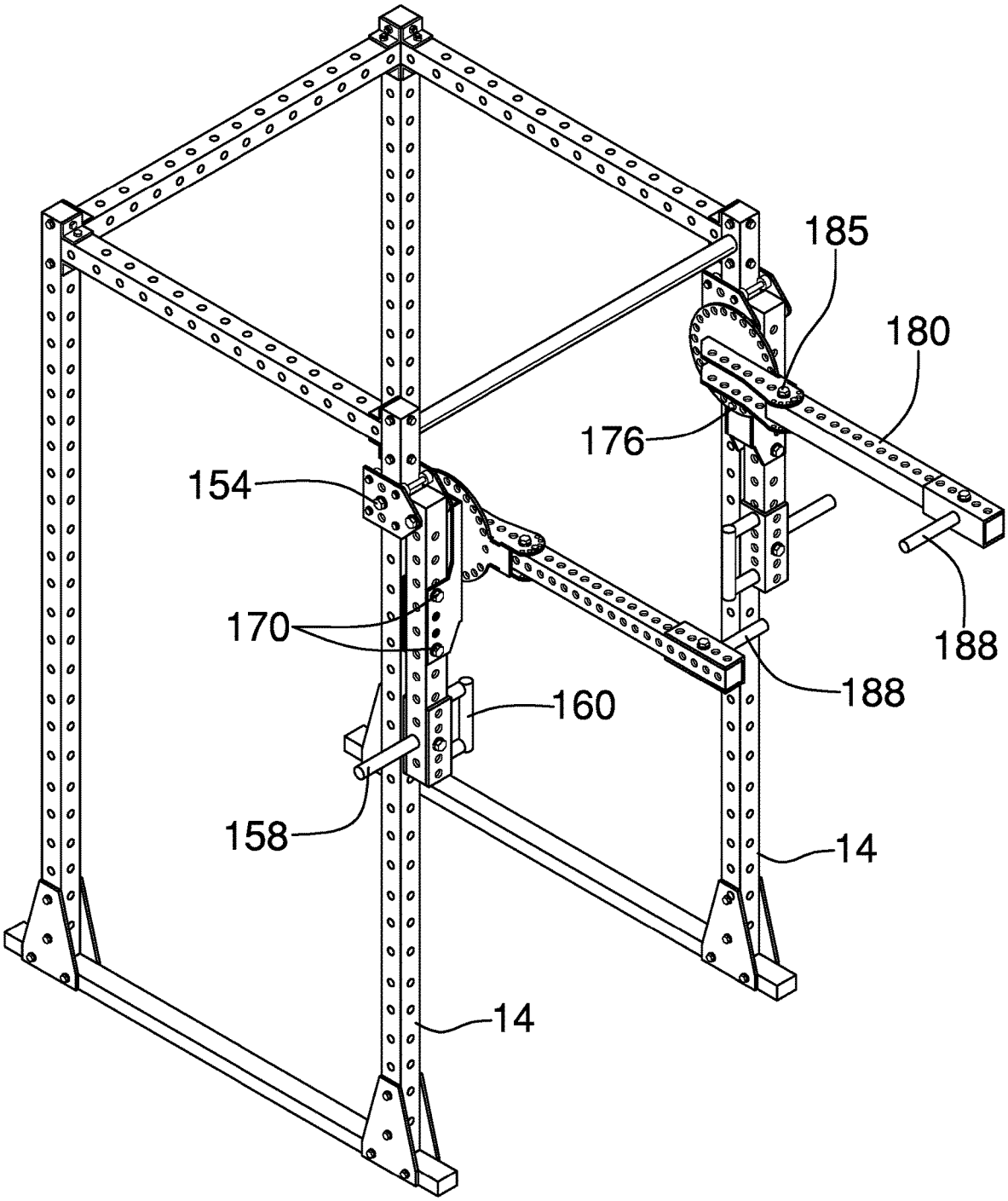
FIG. 25 is a side isometric view of the embodiment of the disclosure shown in FIG. 24.

A lift arm 180 is attached to the plate 173 and has distal end 182 and a proximal end 184 relative to the plate 173. By rotation of the plate 173, an angle between the lift arm 180 and the leverage arm 156 is alterable from 0° to 180°. Generally, this measurement is taken when the lift arm 180 and the leverage arm 156 each lie within vertically orientated planes that are orientated parallel to each other as can be seen in FIG. 25. The lift arm 180 may be pivotally coupled to the mount 162 with a pivot pin 185 such that the lift arm is pivotable about an axis spaced from and orientated perpendicular to an axis of the spindle 172. This allows the distal end 182 to be pivoted laterally relative to the column 14 and is lockable in place with a lock pin 186 or other conventional engagement device. Typically, a pair of the lift arms 180 will be utilized as shown in FIG. 25. The ability to pivot the lift arms 180 allows a user to move the distal ends 182 inwardly, or outwardly, of the user when the user is positioned between the lift arms 180. A handle 188 is attached to the lift arm 180 and may be attached such that it selectively movable along a length of the lift arm 180.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercising assembly being configurable to allow a plurality of different exercises, the exercising assembly including:

a frame including a vertically orientated column;

a connector being mounted the column;

a leverage arm being pivotally attached to the connector such that the leverage arm is pivotal only in a vertical plane;

a weight receiver positioned distal to the connector, the weight receiver being configured to releasably engage one or more weight plates;

a grip being attached to the leverage arm adjacent to the weight receiver;

a mount releasably engaging the leverage arm between a pivot end of the leverage arm and a weight end of the leverage arm;

a spindle extending through the mount and having an axis orientated perpendicular to the vertical plane;

a plate being rotatably mounted on the spindle, the plate being releasably restrained with respect to the mount to retain the plate at a selected rotational position relative to the mount;

a lift arm being attached to the plate, the lift arm having distal end and a proximal end relative to the plate, wherein an angle between the lift arm and the leverage arm is alterable from 0° to 180°; and a handle being attached to the lift arm.

2. The exercising assembly according to claim 1, wherein the connector is vertically movable along the column, the connector being releasably lockable at a selected position on the column.

3. The exercising assembly according to claim 2, wherein the mount is selectively movable between the connector and the weight receiver.

4. The exercising assembly according to claim 2, wherein the lift arm is pivotally coupled to the mount such that the lift arm is pivotable about an axis spaced from and orientated perpendicular to the axis of the spindle.

5. The exercising assembly according to claim 4, wherein the handle is selectively positionable along a length of the lift arm.

6. The exercising assembly according to claim 5, wherein the mount comprises a saddle for receiving the leverage arm, at least one fastener being extendable through the saddle and the leverage arm to releasably secure the mount to the saddle.

7. The exercising assembly according to claim 1, wherein the mount is selectively movable between the connector and the weight receiver.

8. The exercising assembly according to claim 1, wherein the lift arm is pivotally coupled to the mount such that the lift arm is pivotable about an axis spaced from and orientated perpendicular to the axis of the spindle.

9. The exercising assembly according to claim 1, wherein the handle is selectively positionable along a length of the lift arm.

10. The exercising assembly according to claim 1, wherein the mount comprises a saddle for receiving the leverage arm, at least one fastener being extendable through the saddle and the leverage arm to releasably secure the mount to the saddle.

* * * * *